US008316944B2

(12) United States Patent
Pringle et al.

(10) Patent No.: US 8,316,944 B2
(45) Date of Patent: Nov. 27, 2012

(54) SYSTEM FOR PULSE-INJECTING FLUID INTO A BOREHOLE

(75) Inventors: Ronald E. Pringle, Houston, TX (US); Mahendra Samaroo, Edmonton (CA); Brett Charles Davidson, Cambridge (CA); John Michael Warren, Cypress, TX (US); Jason C. Mailand, The Woodlands, TX (US)

(73) Assignee: Wavefront Reservoir Technologies Ltd., Cambridge, Ontario (CA)

( * ) Notice: Subject to any disclaimer, the term of this patent is extended or adjusted under 35 U.S.C. 154(b) by 0 days.

(21) Appl. No.: 12/812,963

(22) PCT Filed: Jan. 19, 2009

(86) PCT No.: PCT/CA2009/000040

§ 371 (c)(1), (2), (4) Date: Jul. 15, 2010

(87) PCT Pub. No.: WO2009/089622

PCT Pub. Date: Jul. 23, 2009

(65) Prior Publication Data

US 2011/0048724 A1 Mar. 3, 2011

(30) Foreign Application Priority Data

Jan. 17, 2008 (GB) ..... 0800830.2
Apr. 30, 2008 (GB) ..... 0807878.4

(51) Int. Cl.
*E21B 34/00* (2006.01)

(52) U.S. Cl. ..... 166/320; 166/373

(58) Field of Classification Search ..... 166/373, 166/386, 319, 320, 321, 177.1, 177.7; 137/494
See application file for complete search history.

(56) References Cited

U.S. PATENT DOCUMENTS

| | | | | |
|---|---|---|---|---|
| 2,670,801 | A * | 3/1954 | Sherborne | 166/249 |
| 3,987,848 | A * | 10/1976 | Canterbury | 166/321 |
| 3,993,129 | A * | 11/1976 | Watkins | 166/319 |
| 4,364,446 | A * | 12/1982 | Thomas et al. | 181/120 |
| 4,628,996 | A * | 12/1986 | Arnold | 166/116 |
| 4,793,417 | A * | 12/1988 | Rumbaugh | 166/312 |
| 5,040,155 | A * | 8/1991 | Feld | 367/85 |
| 5,073,877 | A * | 12/1991 | Jeter | 367/84 |
| 5,103,430 | A * | 4/1992 | Jeter et al. | 367/85 |
| 5,297,631 | A * | 3/1994 | Gipson | 166/299 |
| 5,836,393 | A * | 11/1998 | Johnson | 166/308.1 |
| 6,241,019 | B1 * | 6/2001 | Davidson et al. | 166/249 |
| 6,250,388 | B1 * | 6/2001 | Carmi et al. | 166/311 |
| 6,695,049 | B2 * | 2/2004 | Ostocke et al. | 166/97.1 |
| 6,877,566 | B2 * | 4/2005 | Anderson et al. | 166/373 |
| 7,007,865 | B2 * | 3/2006 | Dodd | 239/225.1 |

(Continued)

*Primary Examiner* — Daniel P Stephenson
(74) *Attorney, Agent, or Firm* — Anthony Asquith Corp.

(57) ABSTRACT

Applying pulses to liquid being injected into wells makes the ground/liquid formation more homogenous, and more penetrative. A system for automatically creating the pulses is described, in which a piston is acted upon by the pressure differential (PDAF) between the supplied accumulator pressure and the formation pressure. The changing levels of the PDAF as the pulse-valve opens (and the PDAF falls) and as the pulse-valve closes (and the PDAF rises) are harnessed to actuate an inhibitor that restrain movement of the valve-piston, and delays opening and/or closing of the pulse-valve. The pulse-valve is engineered to open explosively, and thus create penetrative porosity-waves in the formation. The system includes a pressurized-gas accumulator, and injection-check-valve which can maintain pulsing even when the ground is not saturated, and the static injector, which allows non-pulsed injection only when the ground is non-saturated.

12 Claims, 11 Drawing Sheets

U.S. PATENT DOCUMENTS

| | | | | |
|---|---|---|---|---|
| 7,404,416 | B2 * | 7/2008 | Schultz et al. | 137/835 |
| 7,405,998 | B2 * | 7/2008 | Webb et al. | 367/84 |
| 7,614,452 | B2 * | 11/2009 | Kenison et al. | 166/321 |
| 7,748,462 | B2 * | 7/2010 | Reid | 166/323 |
| 7,806,184 | B2 * | 10/2010 | Schultz et al. | 166/305.1 |
| 2003/0079913 | A1 * | 5/2003 | Eppink et al. | 175/61 |
| 2003/0234107 | A1 * | 12/2003 | Floyd | 166/320 |
| 2005/0178558 | A1 * | 8/2005 | Kolle et al. | 166/373 |
| 2006/0196665 | A1 * | 9/2006 | LaGrange et al. | 166/298 |
| 2006/0278395 | A1 * | 12/2006 | Kenison et al. | 166/312 |
| 2007/0227731 | A1 * | 10/2007 | Contant | 166/278 |
| 2008/0302528 | A1 * | 12/2008 | Samaroo et al. | 166/249 |
| 2011/0036581 | A1 * | 2/2011 | Davidson | 166/305.1 |

* cited by examiner

SYSTEM FOR PULSE-INJECTING FLUID INTO A BOREHOLE

This technology relates to injection of fluids into an in-ground well or borehole. The fluid to be injected can be a gas, such as carbon dioxide, but primarily the technology is aimed at injecting a liquid into the ground formation around the well. The injected liquid can be e.g oil, or e.g water either on its own, or as a vehicle for transporting e.g a remediation substance, either dissolved or in the form of a suspension or slurry, into the ground formation, where the injected liquid mixes with liquids already present in the ground formation. The ground formation can be in e.g a remediable oil field, or can be e.g a contaminated water aquifer. The technology is described herein mainly as it relates to the injection of liquid, primarily water.

It is often (indeed, usually) desirable to apply pulses to the liquid being injected. The fact that the liquid is injected pulsatingly helps to even out the distribution of the liquid into the ground formation, to reduce fingering, and even to homogenise the flow of injected liquid into the ground formation around the borehole.

Systems have been proposed for applying pulses to liquid that is being injected into a porous ground formation. These range from one-off pulse generators, used e.g for creating a seismic disturbance for exploration purposes, to pulse-injecting water from a borehole into the ground to invigorate a deteriorated oil-well nearby.

There is usually a limit as to how much pressure can be exerted on, or in, a particular ground formation. The formation itself can be physically damaged if the pressure exceeds a certain limit. Also, as the ground becomes more saturated, the back-pressure in the ground approaches more closely to this maximum allowed pressure. Thus, the injecting of still more liquid has to be achieved with a shrinking pressure differential. Applying pulses to the liquid being injected can allow engineers to inject a good deal more liquid, despite the shrinking pressure differentials.

These known systems have suffered such disadvantages as limited applicability and usefulness. That is to say, the known pulse-generating systems have had to be designed each for a particular borehole, with its unique combination of parameters including porosity, permeability, saturation, in-ground pressure, etc. The trouble with this is that these parameters change; at first, when remediation starts, the ground is comparatively unsaturated, but then, as injection proceeds, that changes. This change affects the optimum charge-volume per pulse, the optimum frequency, and so on, as required to achieve the most thorough penetration and propagation of the liquid into the formation.

Another disadvantage of the known injection systems has been complexity and fragility. These have been problems because of the need to create and control the pulses by actions taken at the surface.

The present technology is aimed at making it possible simply to insert a pulsing tool into the well or borehole, and for the tool then to adapt itself automatically to whatever the conditions are like, below ground. It is an aim to do this without the need for any input from the surface, other than the pressurised supply of the liquid to be injected, and in particular to avoid the need for down-hole sensors and instrumentation, and to avoid the need for transmission of electrical power, either as regards powering a prime mover or as regards sending signals.

It is recognised that pulses can be made more effective by so engineering the pulse-creating apparatus that the initial opening of the pulse-valve is done very rapidly, whereby a pent-up pressure of liquid is released suddenly—preferably, explosively—into the ground formation surrounding the well. The suddenness of the onset of the pulse can create a porosity wave in the ground, and this porosity wave can be significantly more effective than a slow-rise-time pulse at penetrating a long way into the porous ground formation. It is another aim of the technology to enable the pulses to have a very short rise-time.

By way of further explanation of the technology, examples will now be described with reference to the accompanying drawings, in which.

Figure 13:
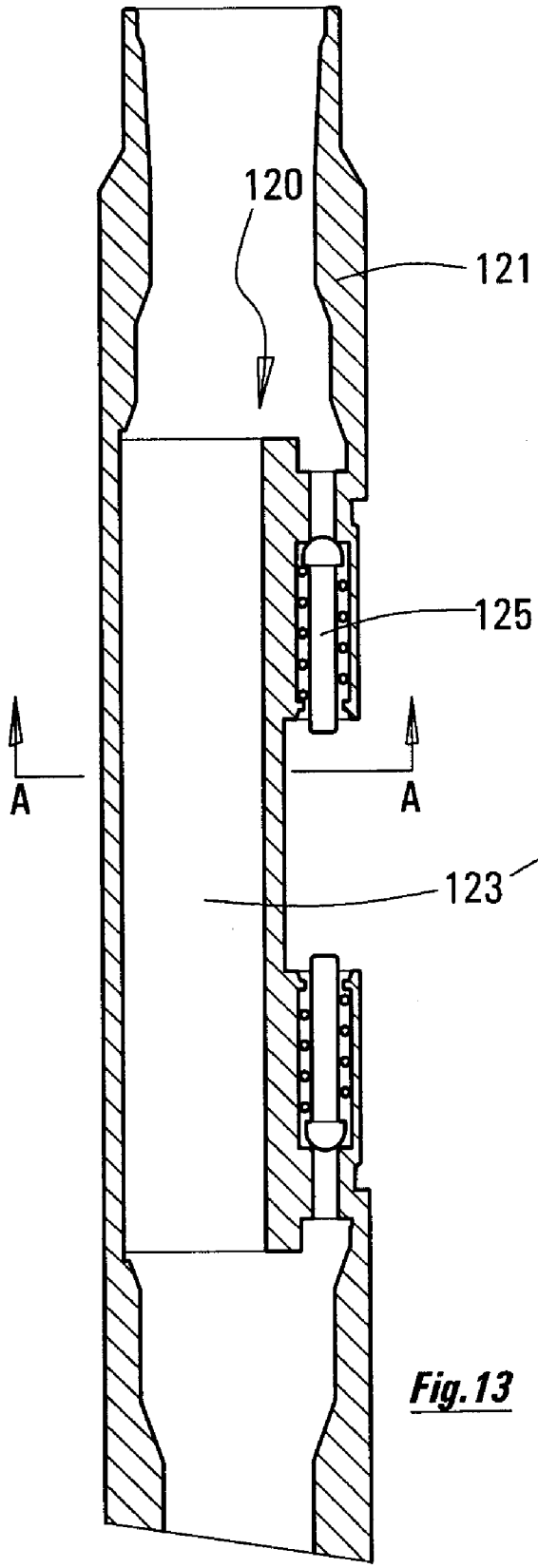
FIG. 13 is a similar section of a static injection sub-assembly.
Figure 13A:
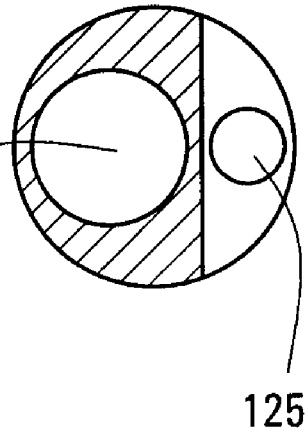

FIG. 13*a* is a section on line a-a of FIG. 13.

Figure 14:
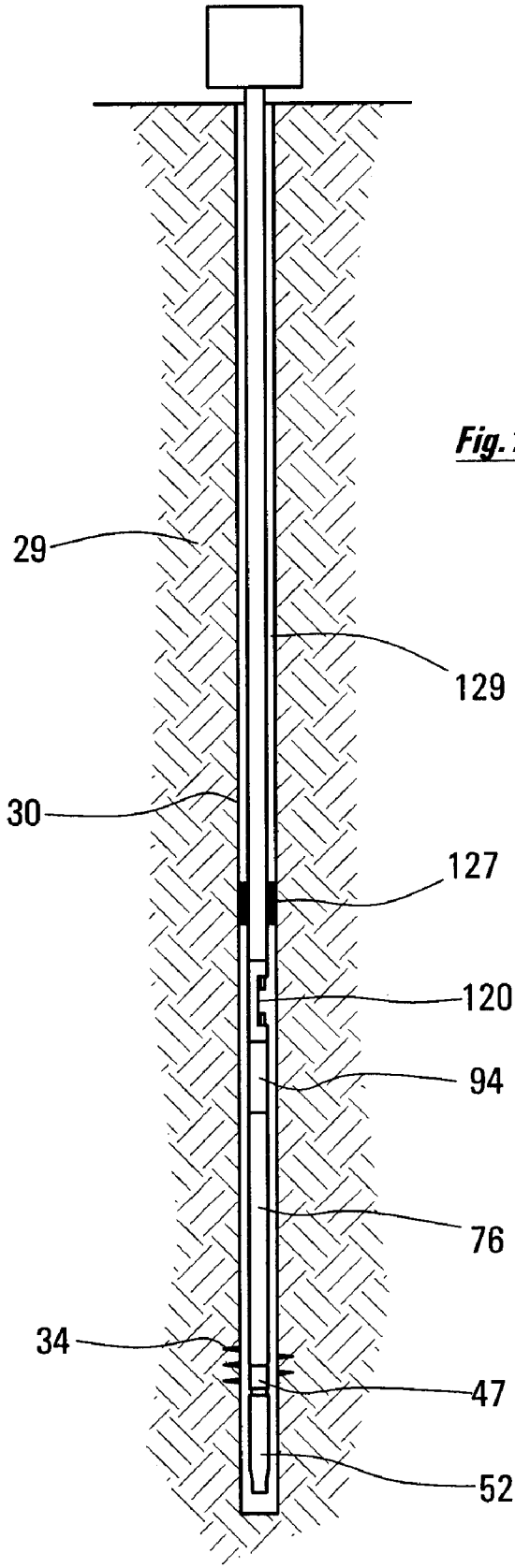

FIG. 14 is a front elevation of a pulsing tool and associated components, shown in a sectioned borehole.

Figure 15:
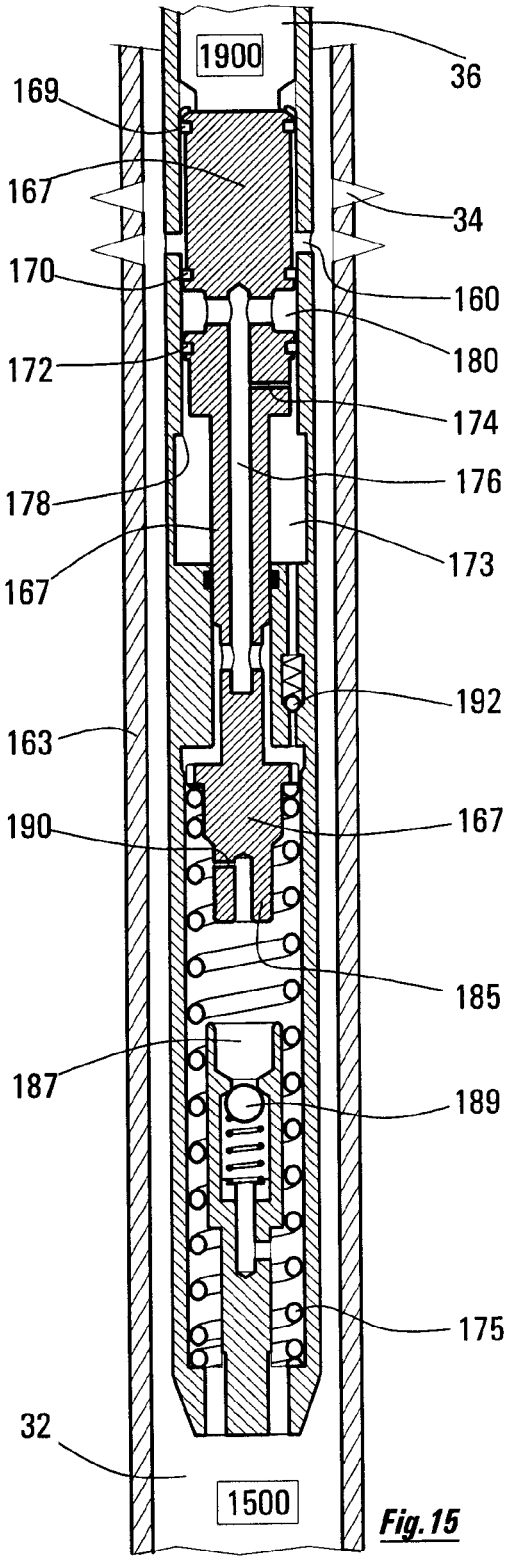

FIG. 15 is a cross-sectional view of a further apparatus for creating pulses in the injected liquid.

FIGS. 16-19 are the same view as FIG. 15, but show different phases of the pulsing cycle.

Figure 1:
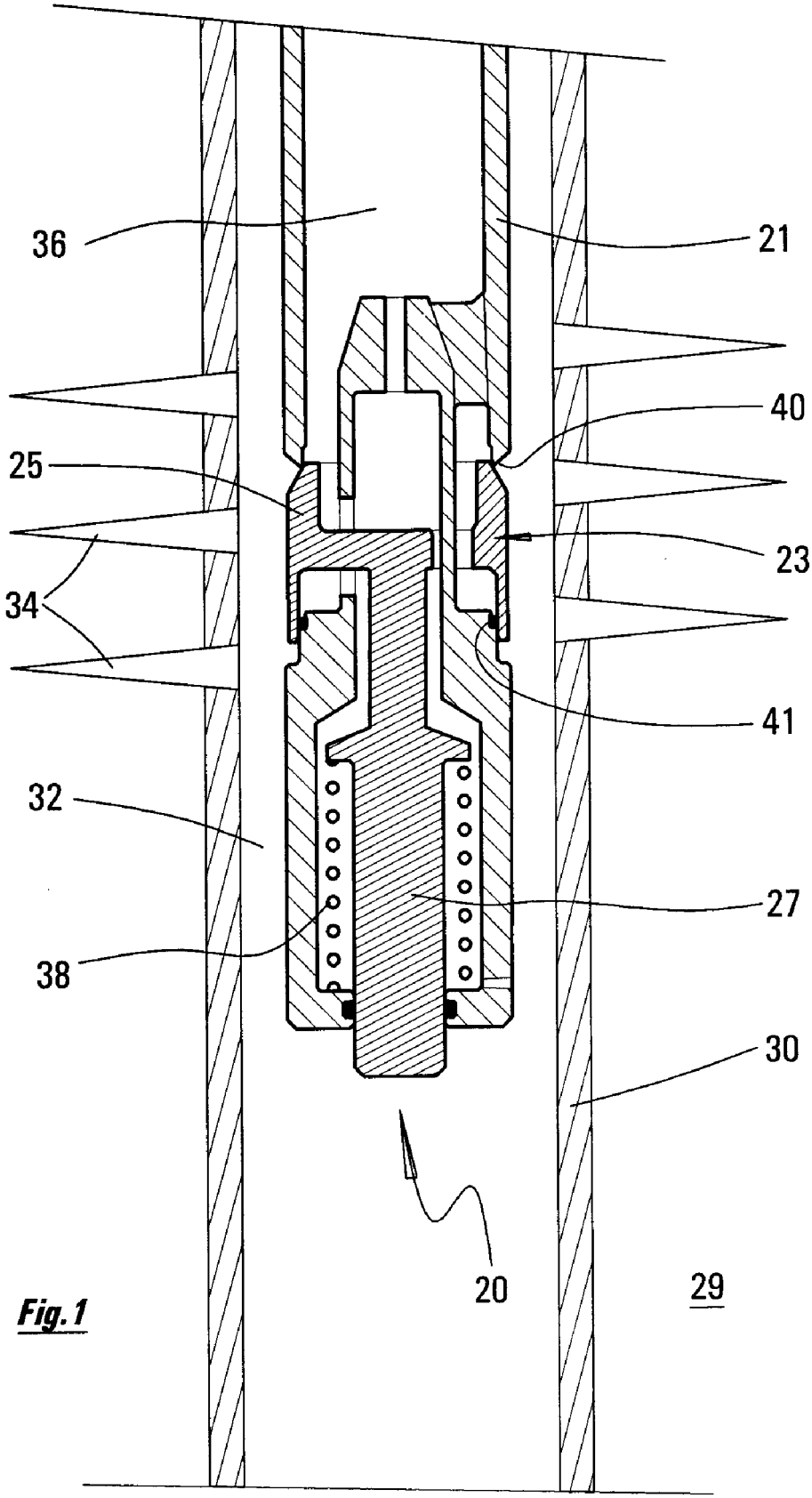
FIG. 1 is a cross-sectional elevation of a borehole, in which is contained a pulsing tool.

As shown in FIG. 1, a pulsing tool 20 includes a tubular body 21, in which is mounted a pulse-valve 23. The pulse-valve 23 includes a movable valve-member 25, to which is attached a piston 27.

The bottom end of the piston 27 is exposed to the pressure present in the ground formation 29 outside the well-casing 30 (or rather, strictly, to the pressure present in the annulus 32 between the well-casing 30 and the tool 20. The annulus 32 communicates with the outside formation 29 through perforations 34 in the well-casing 30). The top end of the piston 27 is exposed to the pressure present in the accumulator zone 36. Thus, a downwards force acts on the piston 27, proportional to the pressure differential PDAF between the accumulator 36 and the formation 29.

The valve-spring 38 serves to urge the piston 27, and with it the valve-member 25, upwards. Thus, the piston 27 moves upwards if the downwards force due to the pressure differential PDAF is small, i.e is less than the upwards force due to the valve-spring 38. The piston 27 moves downwards when the downwards force on the piston due to the pressure differential PDAF exceeds the upwards force on the piston due to the valve-spring 38.

FIG. 1 shows one stage in the pulse cycle. The pulse-valve 23 is closed, whereby the flow of liquid (supplied from the surface) out into the annulus 32, and thereby out into the formation 29, through the perforations 34, is prevented. While the pulse-valve 23 remains closed, the liquid supplied from the surface builds up in pressure in the accumulator zone 36 above the pulse-valve. When the pressure in the accumulator zone 36 has increased sufficiently that the PDAF exceeds a pre-determined magnitude, the piston 27 and the valve-member 25 move downwards.

As the piston 27 and valve-member 25 move downwards, so the pulse-valve 23 opens. The pent-up pressure in the accumulator zone 36 now bursts out of the open pulse-valve, and moves through the annulus 32, and out, through the perforations 34, into the formation 29.

After that, the pressure in the accumulator-zone 36 decreases, and the pressure in the formation increases. Consequently, the differential pressure PDAF between the accumulator and the formation becomes smaller. As the pressures equalize, the valve-spring 38 is now strong enough to move the piston 27 upwards, whereby the pulse-valve 23 closes once more.

Thus, the pulse-valve 23 cycles between open and closed, so long as pressure is supplied from the surface, and so long as the pressure differential PDAF at the end of the pulse is small enough to allow the valve-spring 38 to raise the piston 27, and the PDAF at the FIG. 1 phase of the cycle is large enough to overcome the valve-spring and to drive the piston (and the valve-member 25) downwards.

In the example shown, the pulse-valve seals are slightly unbalanced. That is to say, the valve-member 25 is biased to its closed position against a valve-seat 40, not only by the valve-spring 38, but also by unequal seal diameters. As will be understood from FIG. 1, the effective diameter of the valve-seat 40 is (slightly) smaller than the diameter of the valve balance-seal 41. Both seals 40,41 are exposed to the same PDAF, whereby a (small) net force biases the valve-member 25 closed. The pulse-valve 23 opens when the PDAF exceeds the biasing force plus the spring force.

The designer should see to it that the amount of the unbalance is sufficient to hold the pulse-valve closed during the recovery portion of the pulse-valve cycle, but not so much as to interfere with the operation of the pulse-valve. The smaller of the two seal diameters should be more than about ninety ten percent of the larger, from this standpoint. On the other hand, e.g where the spring force holding the pulse-valve closed is large, the designer might choose to make the two seals of both the same diameter (i.e zero biasing, i.e the seals are balanced), or even negative, whereby the difference in seal diameters now serves to bias the pulse-valve, when closed, towards its open position.

The main seal of the pulse-valve, between the valve-member 25 and the tubular body 21, is, in the apparatus shown, a metal-to-metal seal. Preferably, the designer should specify that the valve-member is made of a harder material than the body. Thus, the valve-member can dig into the metal of the body, which helps ensure a good seal. Another reason for preferring the valve-member to be hard is that it is subjected to erosion from the fast flowing liquid, especially if the liquid contains suspended solids. It is not ruled out, however, that the designer may prefer to incorporate a traditional softer seal material into the main seal.

The very simple system as disclosed in FIG. 1 can be made to work (i.e to continue pulse-cycling) only over quite a small range of operating conditions. These conditions depend on the porosity and permeability of the ground formation, the degree of saturation of the ground formation, the speed at which the accumulator can be recharged, and so on. Unless precautions are taken, the simple system, when operating outside its optimum conditions, is likely either to cease pulse-cycling between open-closed, or to enter a condition in which the valve cycles open/closed at too high a frequency.

As mentioned, a desired characteristic of a pulsing tool is that the pulse-valve should open suddenly, whereby the pent-up pressurised liquid in the accumulator bursts out and creates a sudden violent burst of pressure in the liquid around the borehole. This sudden burst propagates out into the formation, in the form of a porosity wave. Once the initial high-energy burst has passed, now the bulk of the charge-volume of liquid that is to be injected in that one pulse passes out into the formation. The longer the pulse-valve stays open, the greater the charge-volume injected, per pulse cycle.

The more energy there is in the initial burst, the further the resulting porosity wave can be expected to penetrate into the formation. It is the initial burst of energy, just as the valve opens, that is critical to the creation of the high-energy wave. To promote a high speed of opening of the valve, the designer should see to it that the movable valve-member 25 is light in weight, and that the force acting to drive the valve-member downwards is a substantial one, and that the force goes from zero (or small) to very large, very quickly. The designer should also see to it that the cross-sectional areas and configurations through which the injected liquid has to pass present a low hydrodynamic resistance.

Just prior to opening, the valve balance-seal 41 is subjected to the full pressure differential PDAF, and so it can be expected to have a high seal friction. The seal material should be selected for low-friction characteristics (a low friction is more important than e.g an absolute seal) but even so, the resistance to initial opening of the pulse-valve can be significant. Once the valve has started to open, the friction from the balance-seal 41 falls, as the pressure equalises both sides of the seal.

To overcome the effect of the high seal friction, and to assist generally in making the pulse-valve move very rapidly from just-starting-to-crack-open to fully-open, the pulsing-tool may incorporate a hammer. The hammer is movable separately from the valve-member. The designer arranges that, in order to open the valve-member, first the hammer is accelerated up to speed, and then the momentum of the moving hammer impacts against the valve-member. Because of the hammer, some of the resistances to the initial movement of the valve-member are already largely overcome by the hammer, and the valve-member can be expected to move all the more rapidly because of the hammer. The operation of a simple form of hammer is shown in FIGS. 2, 3, 4.

The bottom end of the hammer 43 is exposed to the pressure present in the ground formation 29 outside the well-casing 30 (or rather, to the pressure present in the annulus 32). The top end of the hammer 43 is exposed to the pressure present in the accumulator zone 36. Thus, a downwards force acts on the hammer 43, proportional to the pressure differential PDAF between the accumulator and the formation.

The hammer-spring 45 serves to urge the hammer 43 upwards. Thus, the hammer 43 moves upwards if the downwards force due to the pressure differential PDAF is small, i.e is less than the upwards force due to the hammer-spring 45. The hammer 43 moves downwards when the downwards force on the hammer due to the pressure differential PDAF exceeds the upwards force on the hammer due to the hammer-spring.

Figure 2:
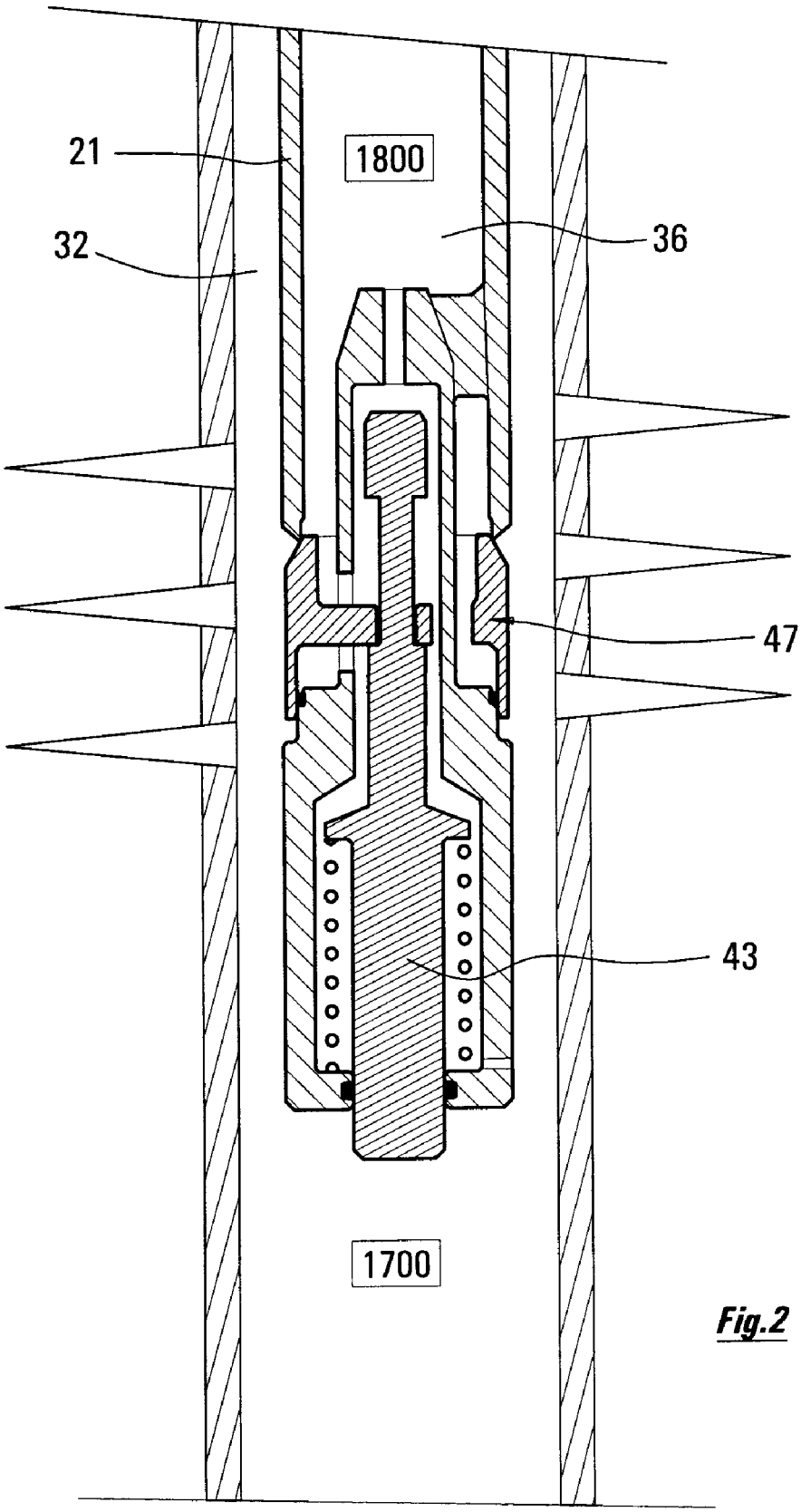
FIGS. 2, 3, 4 are similar sections of another pulsing tool, shown in different phases of the pulsing cycle.
Figure 3:
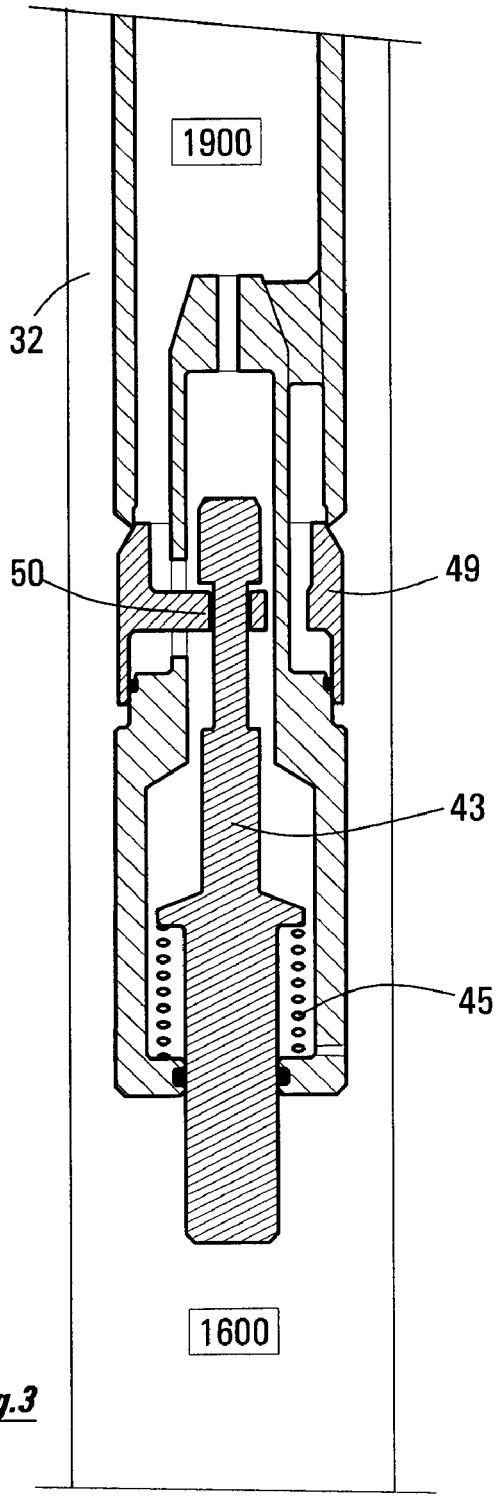
Figure 4:
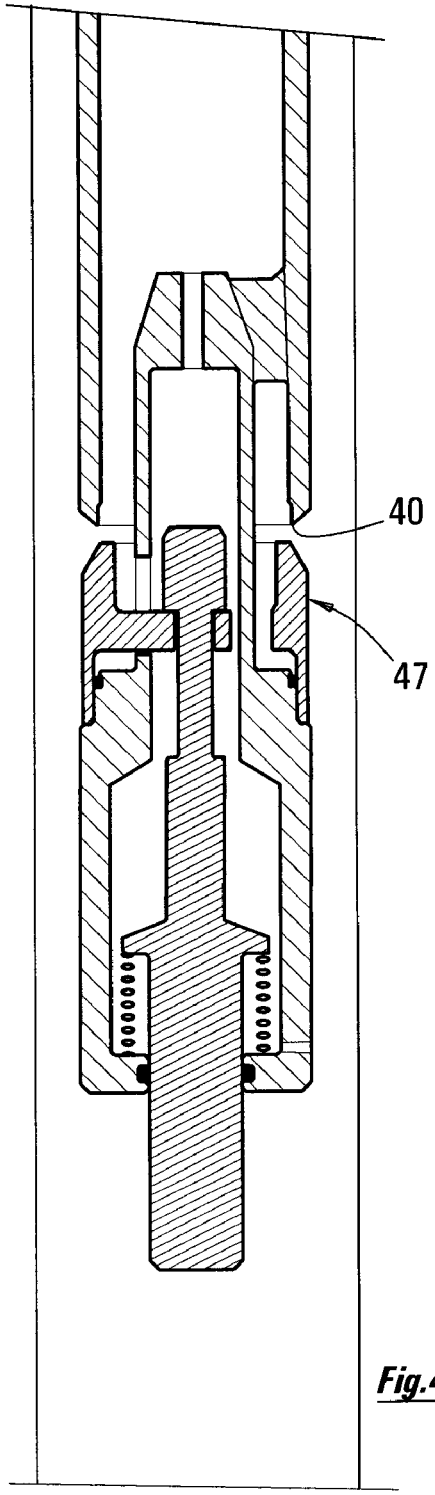

FIGS. 2, 3, 4 show the resulting pulse cycle. In these drawings, typical numerical values have been assigned to the pressures at the various locations, as indicated in the boxes. In FIG. 2, the pulse-valve 47 has just closed. The pressure outside the well-casing (in the formation) is 1700 psi, and falling. (The formation pressure is falling because the pulse-valve 47 is closed, and the liquid that was injected during the recent pulse is now dissipating into the formation.) In FIG. 2, the pressure inside the tool is 1800 psi. Thus, in FIG. 2, the differential PDAF is now 100 psi—which is low enough for the spring 45 to close the pulse-valve 47.

The pulse-valve 47 being closed, the liquid being supplied from the surface builds up in pressure, in the accumulator zone 36 above the pulse-valve, as the accumulator recharges. In FIG. 3, the accumulator pressure has risen to 1900 psi. Meanwhile, the pressure outside continues to fall, being now 1600 psi. When the pressure in the accumulator zone has risen, and the outside pressure has fallen sufficiently that the PDAF exceeds a pre-determined magnitude (e.g 300 psi), the PDAF now overcomes the force due to the hammer-spring 45, and the hammer 43 starts to move downwards. Only the hammer 43 moves at this stage—the valve-member 49 remains stationary, in its closed position, for the moment.

The hammer gains speed and momentum as it moves downwards, until, at the FIG. 3 phase, the hammer is moving rapidly, and is about to impact against the hub 50 of the valve-member 49. The hammer strikes the valve-member, and the pulse-valve 47 opens (FIG. 4).

When the pulse-valve opens, the pressures inside and outside the tool move towards equalisation, as the liquid flows out from the accumulator into the formation. Eventually, the pressure differential PDAF falls below the value at which the hammer-spring 45 can once more close the pulse-valve 47, and the tool returns to the condition of FIG. 2.

Figures 5, 6:
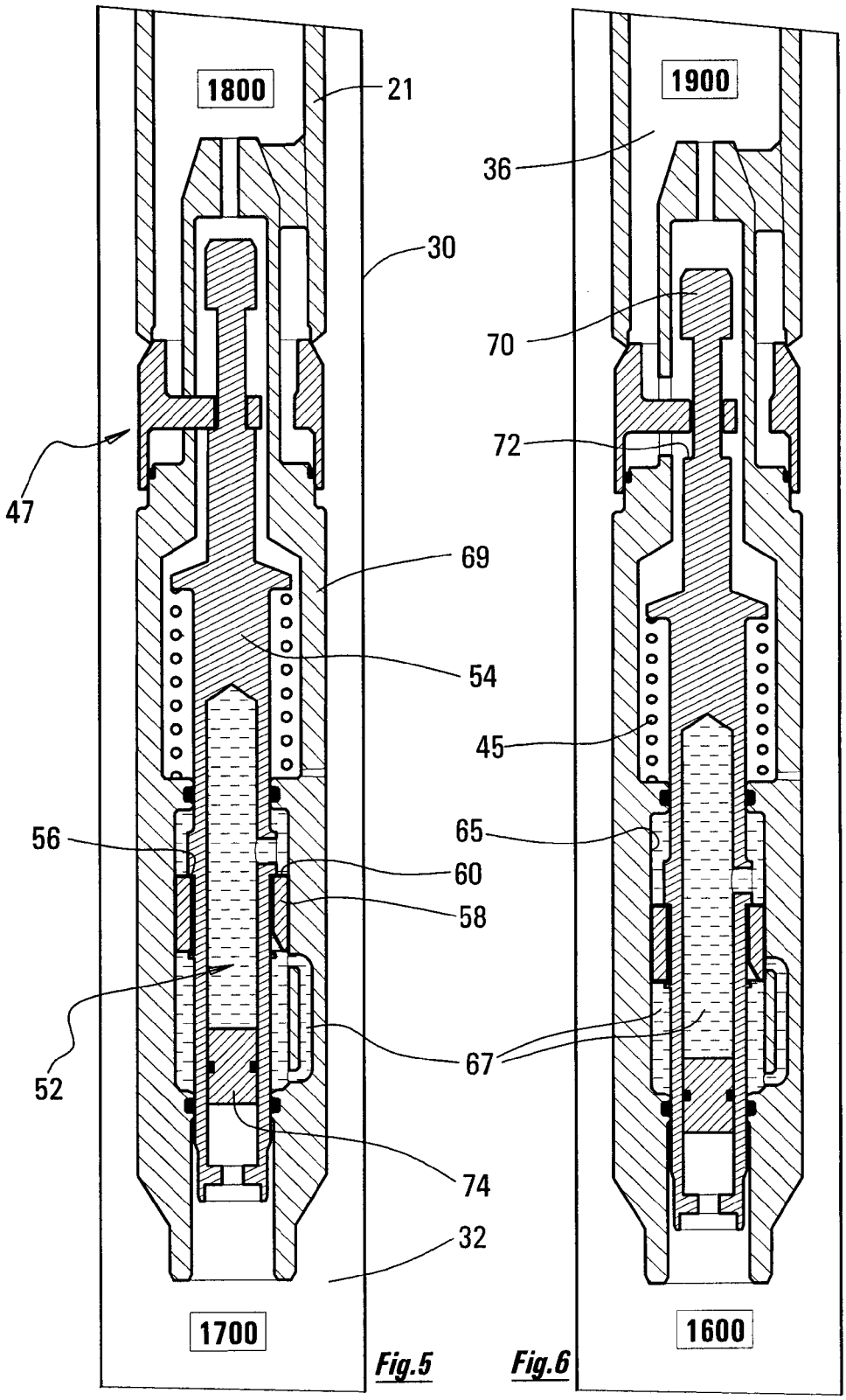
FIGS. 5, 6, 7, 8 are similar sections of another pulsing tool, show in different phases of the pulsing cycle.

The FIGS. 5, 6, 7, 8 apparatus differs from the FIGS. 2, 3, 4 apparatus by the provision of a dashpot unit 52. (Again, in FIGS. 5, 6, 7, 8, the numbers in boxes represent liquid pressures.) In FIG. 5, as the hammer 54 starts to move downwards, a shoulder 56 on the hammer 54 picks up an axially-floating sleeve 58, and urges the sleeve 58 downwards. The oil-filled dashpot functions to inhibit the downwards movement of the hammer 54.

The hammer 54 moves downwards slowly, at first. Meanwhile, at this time, although the hammer is now moving downwards, as shown in FIG. 7, the accumulator pressure at 36 continues to rise (to 2000 psi) and the pressure outside in the formation 29 continues to fall (to 1500 psi—whereby the PDAF has now risen to 500 psi).

Figure 7:
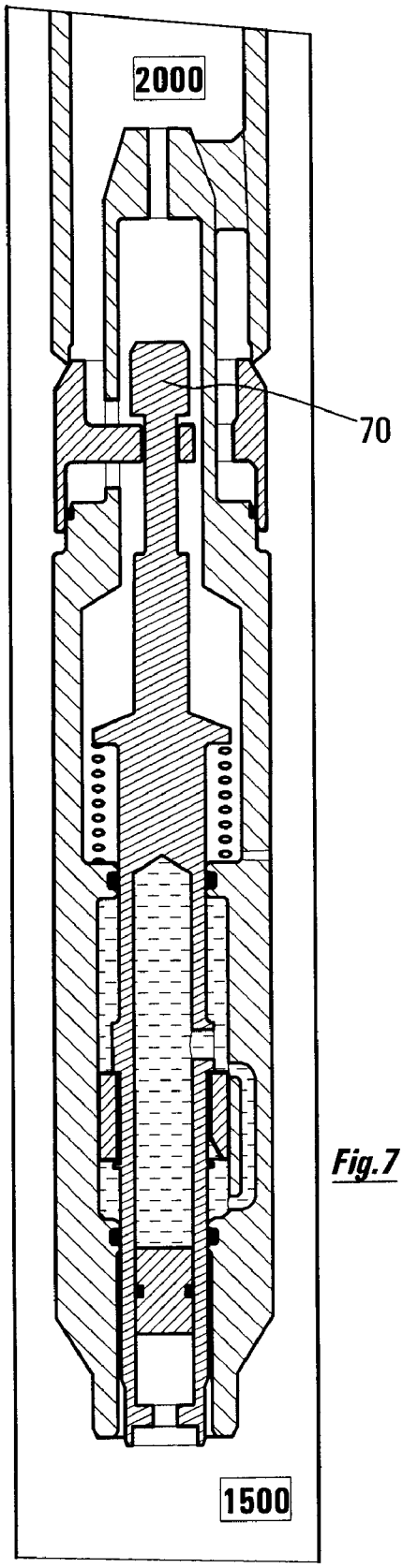

In FIG. 7, the top end 60 of the sleeve 58 has moved far enough downwards that the mouth 61 of the oil-conduit 63 is no longer covered by the sleeve 58. Now, suddenly, there is nothing inhibiting the downwards movement of the hammer 54, and the hammer slams downwards.

Its momentum overcomes the force of the spring 45, and overcomes the biasing force due to the unequal seal diameters. The valve-member 49 separates from the valve-seat 40, and the pulse-valve 47 opens. The pent-up charge-volume of liquid in the accumulator zone 36 bursts, out of the opening pulse-valve 47, and enters the formation.

Figure 8:
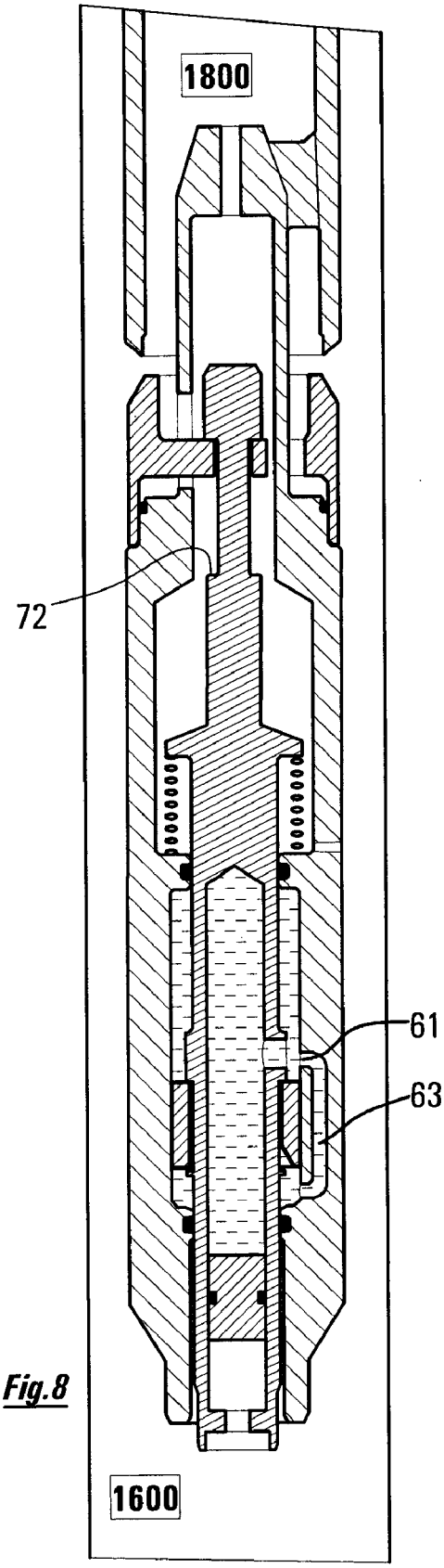

As shown in FIG. 8, with the pulse-valve still open, the accumulator pressure has fallen to 1800 psi, and the formation pressure has risen to 1600 psi. Eventually, the pressure differential PDAF falls far enough that the hammer-spring 45 closes the pulse-valve once more. With the pulse-valve closed, the accumulator re-charges up to full pressure. Then the hammer descends, then the pulse-valve bursts open, and the pulsing cycle continues.

It will be understood that one effect of providing the dashpot is to allow the pressure differential PDAF to rise, just before the pulse-valve opens, to a level that is well beyond the level needed just to overcome the hammer-spring 45.

The provision of the dashpot unit, which is arranged to partially constrain the downwards movement of the hammer 54, as mentioned, enables the pulsing tool to operate over a wider range of operating conditions. That is to say, the tool can now be arranged to adapt itself to the conditions encountered in the well, and to adapt itself automatically to the changing conditions that take place as pulsing continues over a period of time. For example: as the ground becomes more saturated with injected liquid, so the rate of pulsing can be expected to increase.

It should be understood that the distance of propagation of the porosity wave is affected by the changing level of saturation of the ground formation. The more saturated the formation, the more effective (i.e more penetrating) it is to increase the frequency of the pulses. That is to say, the optimum pulsing rate, being the pulsing rate that maximises the penetration of the porosity wave, increases as the ground becomes more saturated. The provision of the dashpot enables the pulsing rate to be at, or nearly at, that optimum rate, as that rate changes due to changing saturation.

The dashpot structure will now be described in more detail. The hammer-sleeve 58 is a tight clearance fit with respect to a bore 65 of the tool body 69. The dashpot 52 includes an enclosed volume 67, in which is contained a quantity of oil. The volume 67 is defined between the hammer 54 and the body 69. The cylindrical outer surface of the hammer-sleeve 58 is dimensioned to be a sliding fit within the bore 65, whereby the hammer-sleeve can move axially up/down within the bore 65. The fit is such as to provide a constriction to the passage of oil, when the hammer 54 and the hammer-sleeve 58 are moving downwards, from below the hammer-sleeve to above.

FIG. 6 shows the situation as the hammer 54 is starting to move downwards. The pulse-valve 47 is closed, and pressure inside the accumulator 36 is building up. In FIG. 6, the pressure in the accumulator is high enough to overcome the force from the hammer-spring 58, but, as the hammer 54 descends, the hammer is restrained in its downwards movement by the dashpot 52.

During downwards movement of the hammer 54, oil is forced through flow-metering orifices on the sleeve 58 and the small clearance gap between the sleeve 58 and the bore 65, whereby the hammer moves downwards only slowly. Meanwhile, the pressure in the accumulator 36 is rising as the accumulator is charged up, with liquid from the surface, under pressure. Thus the pressure differential PDAF becomes larger as the accumulator reaches its maximum allowable charge pressure, which in this example is 2000 psi.

The size of the flow-metering orifices on the axial sleeve 58 and the orifice provided by the small clearance gap is a determinant as to the frequency with which pulsing occurs. The engineers can vary the pulsing frequency by changing the dashpot components accordingly. Other factors, such as the permeability of the ground and the degree of saturation of the ground, affect pulse frequency, whereby the operating engineers can only go so far from the standpoint of controlling frequency. Furthermore, even when the dashpot orifice size is kept constant, the frequency will change (usually, it will increase) as the ground becomes more and more saturated. It will be understood that one of the benefits of the technology described herein is that the apparatus will automatically operate at a higher pulse frequency when the ground, and the liquid in the ground, changes in such manner that a higher frequency can be supported.

The hammer 54 continues its downward movement, against the resistance of the dashpot, as the pressure differential PDAF increases—now to 500 psi in FIG. 7. The hammer moves downwards far enough that the mouth 61 of the flow-back oil-conduit 63 in the bore 65 of the body 69 is uncovered by the hammer-sleeve 58, as shown in FIG. 7. Now, the resistance from the dashpot suddenly disappears, whereby the hammer is free to continue its downwards movement, under the effect of the full 500 psi of the differential PDAF.

The hammer 54 therefore suddenly slams downwards. The head 70 of the hammer 54 strikes the hub 50 of the valve-member 49, and drives the valve-member downwards also. As the pulse-valve 47 bursts open, liquid from the accumulator is discharged out through the valve, out through the perforations 34, and out into the ground formation 29 surrounding the borehole. (Again, the more energetic the initial spurt of pressurised liquid, the further the penetration of the porosity wave into the formation can be expected to be.)

After the initial spurt, a charge-volume of pressurised liquid continues to flow out into the formation. After a time (typically, a second or so), the pressure acting on the top end of the hammer 54 drops e.g to 1800 psi as the accumulator discharges (FIG. 8). At the same time, as the injected liquid is received in the formation, the formation pressure rises e.g to 1600 psi. Thus, the pressure differential PDAF acting on the hammer is falling. When the PDAF has fallen to 100 psi (for example), the hammer-spring 45 is strong enough to overcome this reduced differential, and therefore the hammer 54 starts to move back upwards.

During upwards movement of the hammer-sleeve 58, the top end face 60 of the hammer-sleeve lies clear of the shoulder 56 on the hammer. Thus, oil can now pass freely (downwards) through the large clearance between the hammer-sleeve 58 and the hammer 54, and the dashpot has no effect to slow the upwards movement of the hammer. As the hammer rises, the ledge 72 on the hammer 54 collects the valve-member 49, and closes the pulse-valve 47.

Once the pulse-valve is closed, the pressure from the surface now re-charges the accumulator 36. Meanwhile, the pressure outside the casing 30 falls, as the just-injected charge-volume of liquid dissipates into the formation. The rising accumulator pressure, and the falling formation pressure, means that the pressure differential PDAF therefore starts to increase once again, whereby the pulsing cycle continues.

The dashpot includes an equaliser, comprising a floating piston 74, which ensures that the oil in the volume 67 is always at the pressure of the annulus 32. It is preferred that the volume 67 containing the oil should not be fixed, because the volume of the oil might vary with pressure (mainly because of air entrapped in the oil); and furthermore, the oil might become heated during pulse-cycling of the tool, due to the dashpot action, and the heat might cause the oil to expand. The equaliser-piston 74 simply moves to take up such changes in volume.

The preferred oil is silicone oil, because its viscosity remains stable over a range of temperatures. (The oil can become quite hot when the valve is pulse-cycling over a long period.) Oil viscosity can also be used as a means for controlling frequency, and silicone oil is available in a large range of viscosities, and can easily be blended to provide custom viscosities. The designer should have it in mind that the lubricity of silicone oil can be affected by the materials of the sliding components; for example, where the bore 65 in the tool body is steel, the floating sleeve 58 should be bronze, babbitt, cadmium, sliver, or tin. The designer should also have it in mind to prevent oil loss from the dashpot, so the seals in the dashpot should be engineered for zero leakage.

When the ground formation is less than fully saturated, of course it takes a longer period of time (and a larger charge-volume) before the formation pressure rises high enough for the differential PDAF to be small enough that the pulse-valve 23 can close. It may be noted that a fall in the pressure differential PDAF is accompanied by a corresponding fall in the flowrate of liquid through the (open) pulse-valve, which this fall happens as the ground becomes fully (and over-) saturated. Thus, as the ground becomes more over-saturated, so the frequency of the pulse-valve operation cycle will become faster.

It will be understood that this automatic increase in frequency is beneficial, in that the penetration distance of the porosity waves is (usually) increased by the fact of increased frequency—but only if the formation is increasingly saturated with liquid. With the present pulsing-device, as explained, it happens that the degree of saturation of the formation automatically controls the frequency of pulsing. In fact, it does not take much to so engineer the system that the frequency of pulsing can be more or less optimum under (almost) all operating conditions likely to be encountered.

For present purposes, the formation is said to be "saturated" when no further liquid can be injected by simple (i.e non-pulsed) pressure. The formation is regarded as "over-saturated" when the process of applying cyclic pulses to the liquid as it is injected has enabled more and more liquid to be injected, at a given pressure. It should be borne in mind that sometimes gases may be present, along with the liquids, in the ground formation, and that such gas will have an effect on how much liquid can be injected at a given pressure. Such gas will also have a marked effect on the frequency range over which cycling can take place—and indeed on the effect of cyclic pulsing, especially since the presence of gas reduces the distance a porosity wave can penetrate into the formation.

It will be understood that, by the use of the dashpot, the accumulator can be fully-charged up to its maximum pressure before the valve-member 49 opens. In effect, the dashpot serves to hold the hammer up, even though the pressure differential PDAF itself is nominally exerting considerably more than enough force to overcome the hammer-spring 45. It will be understood that in the FIGS. 2, 3, 4 apparatus, by contrast, the valve-member 49 opened as soon as the force from the pressure differential PDAF simply exceeded the force from the hammer-spring 45—which meant that only under very restricted circumstances was the accumulator charged up to its full allowable pressure at the moment the valve opened.

In the above described apparatuses, the accumulator comprises simply an open space 36 within the tubular housing or body 21 of the tool. When the valve-member opens, the liquid stored in this space is immediately available, and can flow out through the pulse-valve, under the pressure derived from the pump (or pressure head) at the surface. In many cases, however, it is not sufficient simply to have a large volume of liquid available close to the valve. Rather, not only should the large volume of liquid be available, but the volume should be stored under a resilient pressure, so that the volume retains its energy as it is being discharged.

Figure 9:
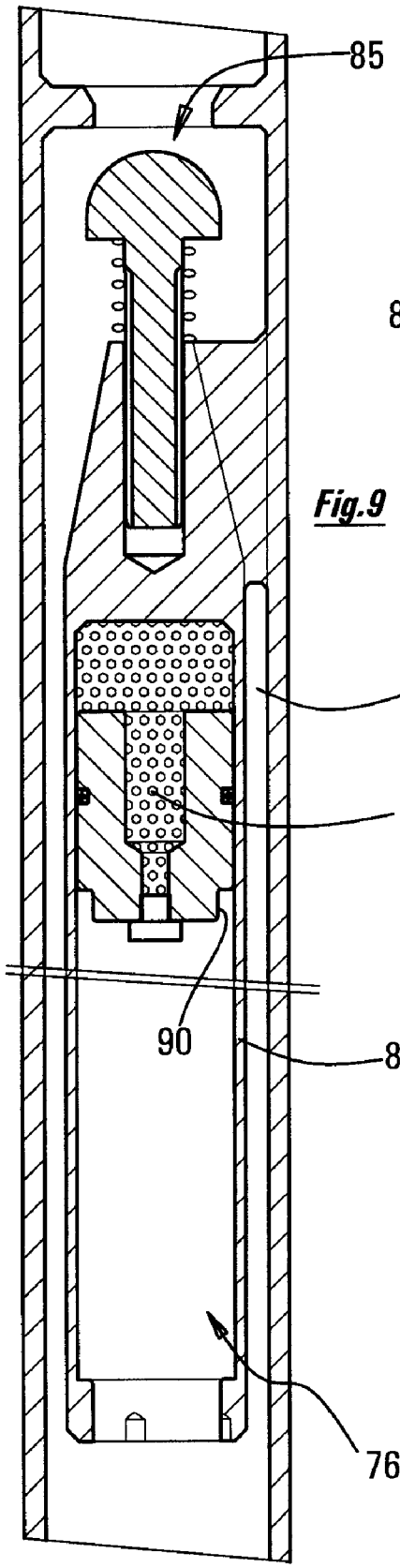
FIGS. 9, 10 are similar sections of a pressurised accumulator of a pulsing tool, shown in different phases of the pulsing cycle.
Figure 10:
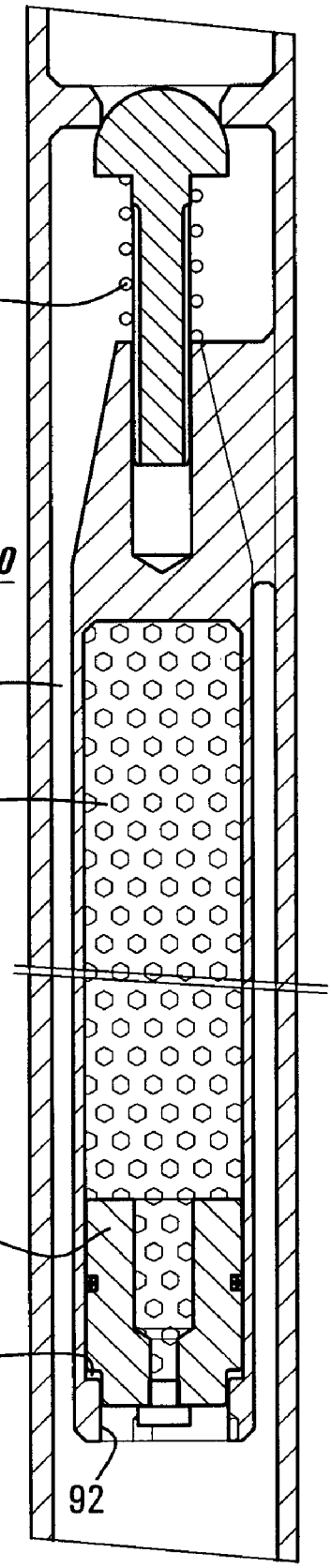

FIGS. 9, 10 show a gas-pressurised accumulator unit 76. Here, a gas-chamber 78 is defined by an accumulator-piston 80 which runs in the bore of an accumulator-tube 81. The chamber 78 was pre-charged (at the surface) with gas (e.g nitrogen). The accumulator 76 includes an (annular) conduit 83 for passing liquid from the surface down into the zone 36 below the piston 80. The piston 80 is exposed to the pressure of liquid in the zone 36; as the pressure in the zone 36 increases, so the piston 80 is forced back up the tube 81, against the pressure of the gas.

The accumulator 76 includes a non-return-valve 85. In FIG. 10, the accumulator has just been completely discharged, as a charge-volume of liquid has been discharged out into the formation. The pulse-valve has now closed, and the accumulator is just starting its recharge, the pressure in the zone 36 below the accumulator being lower than the pressure available from the surface. The non-return valve 85 is open, and liquid is passing downwards therethrough. As pressure builds up in the accumulator, the accumulator-piston 80 rises in the tube 81. The accumulator 76 is fully charged when the pressure in the gas-chamber 78 equals the pressure supplied from the surface. Now, flow stops, and the non-return valve is urged closed by the NRV-spring 87.

A short time later, the main pulse-valve opens, and the accumulator discharges. The fact that the non-return valve 87 is closed ensures that the jolt or surge from the sudden bursting open of the pulse-valve does not pass up the tool, but is directed downwards and outwards, into the formation. The non-return-valve opens soon after the pulse-valve opens, as the pressure in the zone 36 starts to fall.

When the pulse-valve opens suddenly, the potential energy stored in the pressurised gas is released as kinetic energy, which blows the liquid violently out of the open pulse-valve. Again, the more energy contained in the explosive burst of liquid upon initial opening of the pulse-valve, the further the ensuing porosity-wave can be expected to penetrate into the ground formation around the borehole. Thus, the provision of the gas-pressurised accumulator (as distinct from just a container of the liquid), close to the pulse-valve, enables full advantage to be taken of the as-engineered very short time taken by the valve-member 49 to move from closed to open.

However, it should be noted that in some cases the parameters or conditions of the ground, and of operation of the tool, might be such that a gas-pressurised accumulator is not needed. Generally, however, even though there might be a phase of the injection project during which the gas-pressurised accumulator is not used, there will be other phases in which it is used. It may be noted that, in phases where the accumulator would be beneficial, this fact can be sensed by the apparatus itself, and the accumulator automatically carries out its function, during the pulse cycle, to the extent required.

The gas-pressurised accumulator 76 includes a cushion. A nose 90 on the lower end of the accumulator-piston 80 is a small clearance fit in a bore 92 formed in the lower end of the accumulator-tube 81. As the nose 90 enters the bore 92, a volume of liquid is trapped in the space 94, which can only escape by leaking (slowly) through the small clearance.

In an alternative apparatus, the hammer 54 is provided with a similar cushion unit. As mentioned, the hammer 54 is designedly moving very rapidly at the moment when it strikes against the hub 50 of the valve-member 49. The designer might provide that the hammer is then arrested in its downward travel, either by the hammer striking a stop provided for the purpose in the body of the tool, or by the valve-member striking a stop. The former is preferred, in that it is easier to make the hammer robust enough to cope with the end-of-travel impact than to make the valve-member robust enough. Providing a cushion unit to deaden the impact of the hammer against its stop is a convenient way of alleviating problems due to the end-of-travel impact, if the designer should deem it advisable.

In many cases when a liquid is being injected into the ground, at first the liquid pours into the ground at a high flowrate. Then, after a period of time (which might be minutes, hours, or even weeks), the flowrate falls, and a pressure head of liquid in the ground formation around the borehole starts to build up. It might be regarded that, in this first phase, when the ground is not at all saturated, and the outgoing flowrate is large, the injection might as well be done without pulsing, i.e simply by pressurising the liquid into the ground. However, it has been recognised that injecting the liquid using defined repeated cyclic pulses, over a period of time, does have advantages, compared with static injection, even when the ground is quite unsaturated. Chief of these is improved homogenisation of the ground formation, and homogenisation of the distribution of injected liquid in the formation.

When liquid is injected into the ground by simple static injection, the liquid tends to find (and to create) its own pathways through the ground. This is a snowball effect, in that, as a particular pathway is opened up by the movement of the liquid, so the liquid increasingly tends to follow that pathway in future—and, also increasingly, the areas of ground between the pathways tend to receive little or no liquid. This fingering of the injected liquid can be very difficult to overcome, once it has become established. By injecting the liquid in defined pulses, even at the initial stage, the ground can be significantly homogenised, and the onset of fingering can be much alleviated.

When the pulses are created by changes in the differential pressure PDAF, as in the systems described herein, it can be difficult to create pulses during the initial phases of injection, when the pressure differentials, and the variations in the pressure differentials, are small. However, it is recognised that pressure differentials can be amplified—enough to enable them to be used to create pulsing—by the use of an injection check valve (ICV). The ICV serves to limit the amount (i.e the charge-volume) of liquid that is injected per pulse. Without the ICV, if the ground were very porous and unsaturated, pressure differentials sufficient to create pulsing might not arise.

Figure 11:
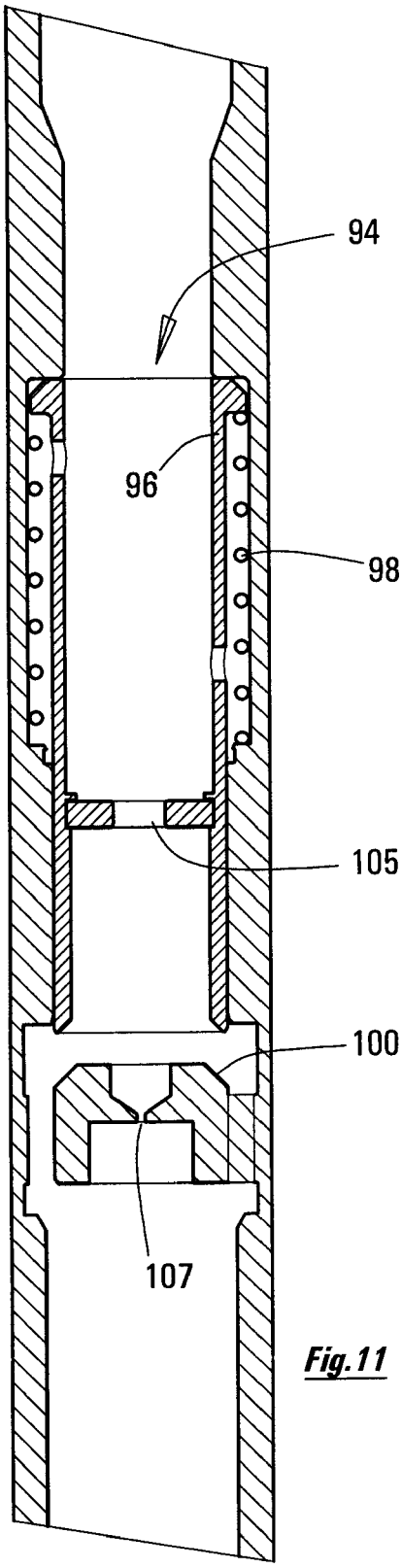
FIGS. 11, 12 are similar sections of an injection check-valve, shown in different phases of its operation.
Figure 12:
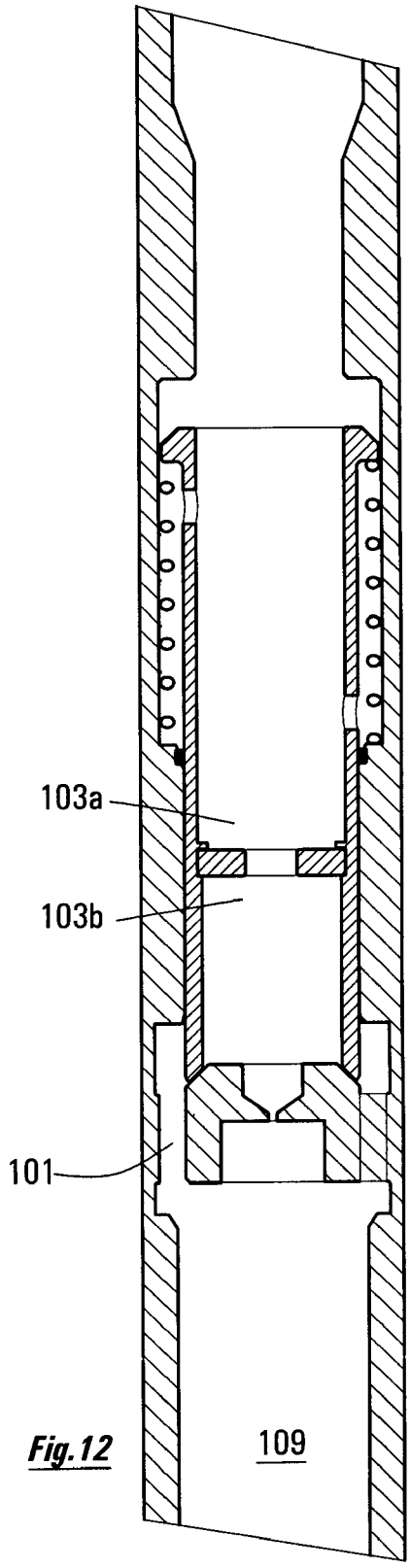

The injection check valve 94 in FIGS. 11, 12 includes an ICV-piston 96. The piston 96 is biased by an ICV-spring 98 such that the bottom end of the piston 96 is held clear of the ICV-seat 100. The seat 100 is formed in the body 69 of the tool. The ICV 94 is located above the accumulator 76.

When the downwards flowrate of liquid is relatively slow, the ICV remains ineffective. The ICV-piston 96 remains in the up position, as shown in FIG. 11, and the liquid passes freely through the open passageway 101 and on down to the accumulator 76. But when the downwards flowrate is relatively fast, a pressure differential builds up between the area 103*a* above, and the area 103*b* below, a restrictor or choke 105, which is unitary with the IVC-piston 96. When this pressure differential, due to high flowrate, is large enough to overcome the ICV-spring 98, the ICV-piston 96 closes against the seat 100 as shown in FIG. 12, cutting off the flow. (In fact, a small flowrate can still pass through the small orifice 107.)

The ICV 94 remains closed until the flowrate passing through the choke 105, and out into the formation, drops to a level at which the pressures in areas 103*a*,103*b* can equalize enough for the ICV-spring 98 to lift the ICV-piston 96 off its seat 100.

Following the stoppage of flow, the pressure in the passageway 101 below the ICV now drops. Consequently, the pressure differential PDAF acting on the hammer 54 also drops. This allows the main pulse-valve 47 to close, thereby preventing further flow out into the formation.

Now the pulse-valve is closed, the accumulator can be recharged, i.e can be recharged up to the pressure required to move the hammer 54. With the pulse-valve 47 closed, the flowrate-induced pressure differential across the choke 105 of the ICV drops, and the ICV re-opens. With the accumulator recharged, the main pulse-valve 47 bursts open, and a fresh charge-volume is injected out into the formation. Then, if the flowrate out into the formation should still be large, the ICV will close again, allowing the pulse-valve, in turn, to close. Thus, the ICV enables pulsing to take place, even though the ground formation is not itself (yet) able to provide back-pressure to the liquid being injected.

Eventually, after perhaps a long period of pulsed injection, the formation approaches saturation. Now, there is back-pressure from the formation, and the flowrate through the choke 105 remains small enough that the ICV remains open. Now, the pressure differential PDAF can vary between the small and large values (e.g 100 psi and 500 psi in the examples mentioned) required to maintain the pulse-valve in its ongoing open-close-open-close cycle.

Again, it will be noted that the tool itself senses when the flowrate is so large that the ICV is needed to create the conditions in which the main pulse-valve can close and open cyclically. Once the flowrate is small enough that cyclic pulsing is self-sustaining, automatically the ICV then remains inoperative.

It will be understood that the function of the ICV might be duplicated by interrupting the supply of liquid being fed down into the tool from the surface. It is possible to sense, in most cases, whether pulsing is taking place below ground, simply by observing a pressure gauge at the surface. When pulsing is occurring, the gauge raises and falls to the period of the pulses. However, controlling the flowrate from the surface requires control and human decision-making—while the ICV automatically senses when it is needed, and automatically performs its function. And sometimes, the depth at which the tool is operating rules out effective control from the surface, in any event.

Sometimes, the ground is so porous and unsaturated that the differential PDAF between the supply pressure and the formation pressure remains large, to the extent that pulsing is significantly slowing down the rate at which ground formation is filling up with liquid. FIG. 13 shows a static injector sub-assembly (SIS) 120, which can help alleviate this problem.

The liquid to be injected passes down from the surface through the hollow interior of the tubing 121 above the tool. There is no opening in the wall of the tubing above (i.e upstream of) the SIS 120. Normally, the liquid simply passes straight through the SIS, through the always-open SIS-conduit 123, on its way down to the ICV 94, the accumulator 76, the pulse-valve 47, and the other components as described. The liquid passes out into the annulus 32 (and thence into the formation 29) if the pulse-valve 47 is open, and does not pass while the pulse-valve is closed. Thus the liquid passing through the SIS-conduit 123 is subject to pulsing, and to pulsing so arranged as to create the initial high-energy porosity wave, as described.

However, if the pressure differential between the liquid inside the SIS and the annulus 32 outside the SIS should exceed a predetermined value (e.g 300 psi), the check-valve 125 in the SIS now opens, allowing liquid to flow outwards into the annulus 32. This liquid passes straight out into the formation, and is not subject to pulsing. The flow through the SIS check-valve 125 (actually, as shown, the two check-valves) continues so long as the pressure differential across the check-valves is large enough to overcome the check-valve springs 98. When sufficient liquid has been injected for the in-ground back-pressure to be high enough for the pressure differential to drop below the level determined by the check-valve springs 98, the SIS check-valves 125 close again.

Of course, the flow of liquid through the open SIS-conduit 123 continues, even when the SIS check-valves 125 are open. Thus, when the check-valves are open, the part of the flow that passes through the open SIS-conduit 123 is subject to pulsing, while the other part of the flow, which passes through the check-valves 125, is not subject to pulsing. Even so, the pulsing that remains is, or can be, sufficient to assist in homogenising the ground and the distribution of liquid in the ground formation.

As the ground becomes saturated, and back-pressure builds up, the check-valves close, and all the liquid passes through the SIS-conduit 123.

FIG. 14 shows a layout of an ensemble of the various components as described. An inflatable packer 127 has been placed in the annulus 32, above the level of the SIS 120. The portion 129 of the annulus above the packer would normally be filled with water (or other liquid); the packer 127 may be configured rather to prevent shock waves and pulses from being dissipated upwards than to support the full pressure of the down-hole liquid.

It will be understood that some of the constructional details of the apparatuses have been simplified, in the drawings. Of course, the designer must see to it that the components can be assembled together, suitably for being lowered down a borehole. The designs as shown are suitable for a pulsing tool that is to be used at depths of hundreds of meters.

The designers choose the limits for the upper and lower magnitudes of the PDAF at which they desire the pulse-valve to open and close. The designers put the desired opening and closing pressures into practical effect by selecting the diameters and areas of the components of the apparatus that are moved by the various pressures and differential pressures, and by selecting appropriate spring-rates etc.

It can be a simple matter to arrange the design of the tool such that the tool can be dismantled, in the field, sufficiently to enable the hammer-spring to be changed, and thus to change the PDAF values at which the pulse-valve opens and closes.

With a typical size of tool, and in a typical well, the pulsing frequency might vary from say one cycle in ten seconds (at the start of pulse-injecting, when the ground is less saturated, to say one or two cycles per second, as the ground formation reaches maximum over-saturation and a large back-pressure build up in the formation. Typically also, pulsing continues over a period of days or weeks. It might take several days, or a few hours, for a back-pressure to build up in the formation, such that there is some measurable residual pressure left in the formation-space immediately before the pulse-valve opens.

The term "saturation" as used herein may be explained as follows. The ground formation is said to be "simply-saturated" when no more liquid can be injected into the ground without pulsing. Usually, in the type of ground formation with which the present technology is mainly concerned, the saturation condition cannot actually be achieved; that is to say, it is always possible to inject some more liquid, e.g at a slow flowrate, because injected liquid always dissipates into the surrounding ground at a slow flowrate.

It is always possible to inject more liquid into the ground, beyond the "simple-saturation" point, simply by raising the steady (non-pulsing) injection pressure—taking care, of course, not to exceed the practical limit beyond which the ground formation would or might be physically damaged by a further increase in injection pressure. The "simple-saturation" condition is a condition that is associated with static injection, i.e non-pulsed injection.

The term "over-saturation", as used herein, refers to the injection of more liquid into the ground, beyond the simple-saturation condition, as a result of applying pulses to the liquid as the liquid is being injected. Practically any type of pulsing can enable at least a small degree of over-saturation; the technology described herein, when performed properly, can enable a very large degree of over-saturation to be achieved.

For the purposes of this specification, the ground is said to be fully or completely over-saturated when, after a long period of pulse-injection, the back-pressure in the ground is so high that every drop of liquid that is injected into the formation during the injection-stroke of the pulse-cycle travels back into the borehole during the recovery-stroke of the pulse-cycle. Again, in real practical ground formations, the fully over-saturated condition is never quite achieved, i.e the volume recovered, per pulse, is never quite as much as the volume injected per pulse.

The amount of liquid that must be injected into the ground in order to achieve, or to approach, the fully over-saturated status depends on many things, but chiefly on the pressure at which the injection is carried out (which, as mentioned, usually has to be limited for geophysical reasons). It is generally the aim of the designers and engineers to inject as much liquid as possible into the ground, per well, in as short a time as possible, within the limitations imposed by the maximum injection pressure. In practice, it will always be possible to inject some more liquid into the well, after a time, because the already-injected liquid will have dissipated somewhat into the surrounding ground, after a time.

FIGS. 15-19 show a variant of the dashpot design that was described with reference to FIGS. 5-8. In FIG. 15, the pulse-valve 23 comprises a series of injection-ports 160 pitched around the tubular body 163 of the tool, through which pressurized liquid in the accumulator-space 36 can pass, except that, in FIG. 15, piston 167 is closing off the injection-ports 160. The piston 167 carries three seals—a top seal 169, a middle seal 170, and a bottom seal 172—and when the piston is in its UP position, as in FIG. 15, the injection-ports 160 lie between the top seal 169 and the middle seal 170.

Figure 16:
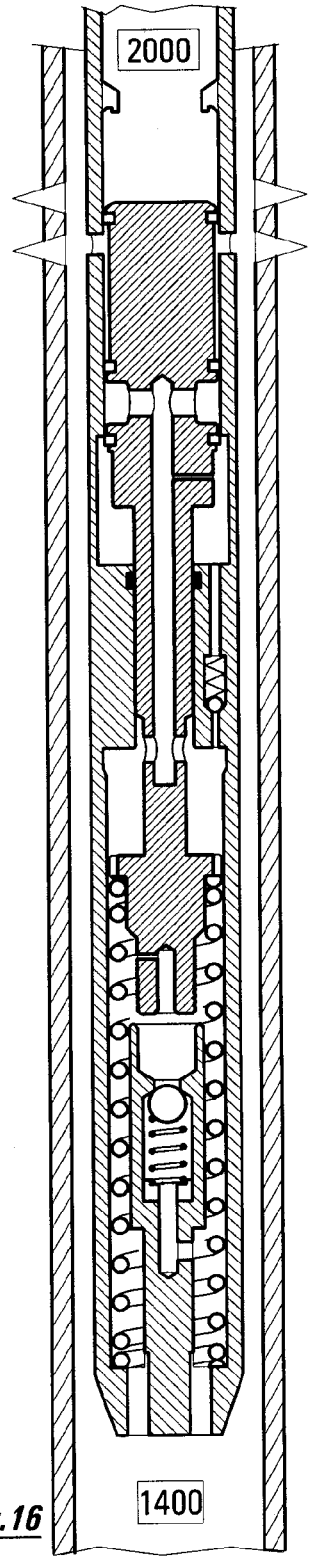

In FIG. 16, the pulse-valve 23 being closed, the accumulator-pressure in the accumulator-space 36 is increasing—for example to 2000 psi as shown—while the formation-pressure is decreasing, for example to 1400 psi as shown. Thus, in FIG. 16, the PDAF stands at 600 psi, which is the highest level the PDAF reaches in this example. The PDAF-force acting on the piston 167 acting downwards, i.e in the direction to open the injection-ports 160) is of quite large magnitude—especially so because, in the tool of FIGS. 15-19, the upwards-facing accumulator-surface of the piston, over which the accumulator-pressure acts, is of larger area than the downwards-facing formation-surface of the piston, over which the formation-pressure acts. Opposing the downwards-acting PDAF-force on the piston is the upwards-acting spring-force due to the piston-spring 175. Also opposing the PDAF-force is the pressure in the dashpot-chamber 173.

Liquid in the dashpot-chamber 173 is, in FIG. 16, only able to leave the dashpot-chamber through the constricted-port 174. Liquid escaping through the constricted-port emerges into the drain 176 in the piston 167. The drain 176 connects with the formation-space 32.

The constricted-port 174 is tight enough to support a level of pressure inside the dashpot-chamber 173 that is considerably higher than the formation-pressure, and thus pressure in the dashpot-chamber is high enough to prevent the piston from moving downwards under the large PDAF-force. The pressure of the liquid in the dashpot piston depends on the relative areas exposed to the pressures acting on the piston; in the example shown, the pressure in the dashpot-chamber 173, under the conditions of FIG. 16, might be 2300 psi, for example (noting that the said relative areas might require the dashpot pressure to be higher than the accumulator pressure).

As the liquid in the dashpot-chamber 173 leaks slowly away through the constricted-port 174, so the piston 167 moves slowly downwards. In FIG. 16, the bottom-seal 172 is just about to break free of the shoulder 178.

Figures 17, 18, 19:
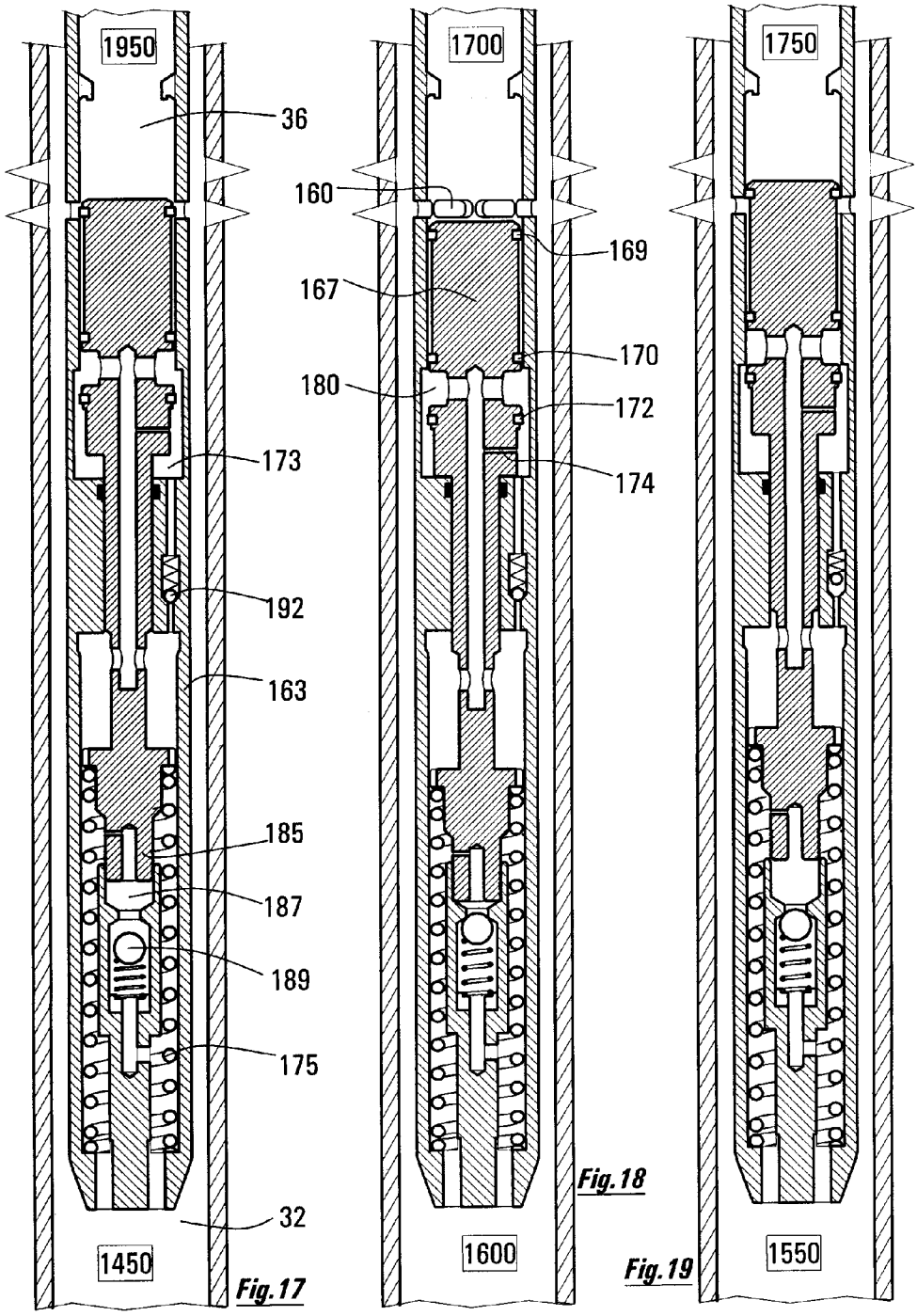

In FIG. 17, the bottom-seal lies below the shoulder 178, and now the wide-open discharge-port 180 is open to the dashpot-chamber 173. Excess pressure in the dashpot-chamber is now no longer supported, and the dashpot-chamber pressure rapidly falls until it is equal to the formation-pressure. The large PDAF-force now dominates the piston 167, driving the piston forcefully downwards. In FIG. 17, the top-seal 169 is just starting to uncover the injection-ports 160, whereby the pulse-valve is just starting to open. Liquid explodes out of the injection ports 160, whereby the accumulator-pressure decreases and the formation pressure increases—respectively to, in FIG. 17, 1950 psi and 1450 psi, whereby the PDAF is 400 psi, and falling.

In FIG. 18, the injection-ports 160 are fully open, and pressurized liquid from the accumulator space 36 is pouring out through the perforations 34, and into the ground formation.

The sequence of events that take place while the components are in the positions shown in FIG. 18 will now be described. The PDAF, though falling, remains high enough to drive the piston downwards, against the spring-force, until the piston has travelled all the way down to the FIG. 18 position. This fully-down position might be reached when the PDAF has fallen to, say 350 psi. The pulse-valve having been open for some time, and the charge-volume of liquid is injected into the ground, the accumulator-pressure decreases and the formation-pressure increases, and thus the PDAF continues to fall. Eventually, the PDAF-force on the piston 167 drops to 300 psi, and the designers have arranged (in this example) that, at a PDAF of 300 psi, the spring-force on the piston is now equalized or balanced by the PDAF-force on the piston. As the PDAF drops below 300 psi, i.e below that equalization-level, the piston 167 is therefore urged to rise, i.e to move in the direction to close the pulse-valve 23.

The piston 167 is prevented from moving upwards at this time, even though the PDAF is below 300 psi, its equalization-level (i.e even through the spring-force exceeds the PDAF-force), because a catchpot mechanism has been provided in the tool. The piston 167 is provided with a nose 185, which is a tight fit inside a catchpot-chamber 187. When the piston was travelling downwards (FIG. 17) and the nose 185 entered the catchpot-chamber 187, it did so without restraint, in that any pressure build-up inside the catchpot-chamber was simply discharged through a catchpot check-valve 189. The check-valve 189 is shown in its OPEN position in FIG. 17.

Thus, the tool remains in the FIG. 18 fully-down condition, with the pulse-valve still open and the PDAF still decreasing. When the PDAF falls below its equalization-level (300 psi in the example), the forces urging the piston 167 to rise, and to close the pulse-valve, therefore continue to increase, and consequently pressure can now build up in the catchpot-chamber 187. This pressure can escape, but can escape only slowly, through a catchpot-orifice 190. Therefore, the piston 167 rises, but only slowly, as the PDAF drops below its equalization level.

At last, the top-seal 169 closes off the injection-ports 160, the PDAF being now at its lowest level, e.g 100 psi (well below its equalization-level), at the moment when the pulse-valve closes. Now, the PDAF is still, for the moment, considerably below its equalization-level—although, the pulse-valve 23 being now closed, the PDAF is now increasing. The piston 167 continues to rise slowly at this time.

FIG. 19 shows the position just as the nose 185 is about to move clear of the catchpot-chamber 187, and the pulse-valve has just closed. Once the nose is clear, there is no longer any restraint on the piston 167, and the piston moves rapidly upwards, until the piston reaches the top of its travel, once again, as shown in FIG. 15.

It may be noted that the PDAF would still be below its equalization-level when the piston reaches the top of its travel. (The piston would not reach the top of its travel (the FIG. 15 position) if the PDAF were to rise above the equalization-level before the piston reached that point.) It may be noted also that the dashpot-chamber 173 is able to refill unrestrictedly with liquid from the formation-space 32, via the now-open dashpot check-valve 192, as shown in FIG. 19. The designers of course have to plan out at what levels of the PDAF they want the pulse-valve to open and close, and they have to design the piston areas, spring-force, orifice sizes, etc, so that the tool functions to operate the pulse-valve at those levels.

In FIG. 19, the PDAF is increasing, and eventually the PDAF surpasses its equalization-level. Now, the piston is urged to move downwards, in the direction to open the pulse-valve, but is prevented from doing so for a period of time as determined by the dashpot, which restrains the downwards travel of the piston. The piston travels downwards only slowly, but eventually the bottom-seal 172 once again breaks clear of the shoulder 178, and the pulse-valve 23 opens again, and the pulsing cycle continues.

In the tool of FIGS. 15-19, the pulse-valve 23 opens rapidly, for the reasons again as previously described. The rapid opening is achieved in that, as shown in FIG. 16, just as the pulse-valve opens, the resistance of the dashpot drops, almost instantly, to zero, whereby the available heavy force in the direction to drive the pulse-valve open, as derived from the high level of the PDAF, is suddenly unleashed onto the piston.

The tool of FIGS. 15-19 is capable of creating a degree of suckback of liquid, during the recovery or recharge (pulse-valve closed) portion of the pulse cycle. In suckback, a volume of liquid is sucked from the formation back into the tool. In order to engineer suckback, a suckback-cavity is created, inside the tool, to create space for the volume of the sucked-back liquid to flow into, after the pulse-valve has closed. (The suckback cavity should be created after the pulse-valve has closed, because, if the cavity were present when the pulse-valve was open, the cavity would fill with liquid from the accumulator, not from the formation.) Such a suckback-cavity is created, in this case, by the fact that, after the pulse-valve 23 has closed, the piston 167 continues to travel upwards. This further movement of the piston creates the cavity by effectively increasing the volume of the formation space 32.

When injecting liquid into the ground, applying pulses to the liquid being injected can be regarded generally as beneficial. Of course, any injection system can inject more liquid simply by raising the injection pressure; in fact, in traditional injection systems, raising the injection pressure often is the only way to inject more liquid into the ground. The present technology is aimed at providing a tool that enables maximization of the amount of further liquid that can be injected into a ground formation that is already over-saturated (and thus its formation-pressure is high), in the situation where a further increase in injection pressure or accumulator-pressure is not permitted or is otherwise contra-indicated.

The technology as described herein provides a down-hole tool for pulse-injecting pressurized fluid from a fluid-reservoir out from a hole in the ground into the surrounding ground formation. The tool includes a pulse-valve, which is operable between an open condition and a closed condition. In the open condition, fluid from an accumulator is able to pass through the valve, and to pass out into the ground formation surrounding the well or borehole. The designers so arrange the tool, in relation to the pressurized fluid-reservoir, that, when the pulse-valve is closed, during operation, the accumulator-pressure is increasing, and when the pulse-valve is open the accumulator-pressure is decreasing. The (changing) pressure differential between the accumulator-pressure and the formation-pressure is termed the PDAF. The technology is especially applicable when the environment in which the tool is used is such that the changes in the PDAF take place gradually—that is to say, when, during a pulse-injection operation, the PDAF moves from its highest level (at which the pulse-valve opens) to its lowest level (at which the pulse-valve closes) it does so over a time period that is of the order of a second.

The present technology would be less effective in a case where the PDAF were to drop from highest to lowest in less than e.g a tenth of a second. Also, if it were to take more than e.g ten seconds for the PDAF to change, the beneficial effects of pulsing would tend to be lost. (Some unusual combinations of e.g liquid viscosity and formation porosity/permeability can impose unusual operational parameters, outside these limits.)

The tool includes a valve-piston. Variant tools are shown in FIG. 1, FIGS. 2-4, FIGS. 5-8, and FIGS. 15-19, and in each variant, an accumulator-surface of the valve-piston is exposed to the accumulator-pressure, and an oppositely-facing formation-surface of the valve-piston is exposed to the formation-pressure. Given that the accumulator-pressure is, during operation of the tool, higher than the formation-pressure, the PDAF gives rise to a resultant force that acts on the valve-piston.

The designers arrange for this PDAF-force on the valve-piston to urge the valve-piston to move in the direction to open the pulse-valve from its closed position (or, if the pulse-valve is already open, in the direction to maintain the pulse-valve in its open position), and arrange that, the higher the PDAF, the more forcefully the valve-piston urges the pulse-valve open.

In each variant, there is also a bias-means, which exerts a bias-force on the valve-piston, urging the valve-piston to move in the direction to close, or to keep closed, the pulse-valve. The bias-means conveniently is a mechanical spring, e.g a coil-spring. The bias-means should be capable of exerting its bias-force on the valve-piston even though the valve-piston moves to different locations, and the bias-means should be so arranged that the bias-force remains reasonably constant over the range of movement of the valve-piston, keeping the maximum bias-force at no more than about double the minimum bias-force over the movement range of the valve-piston. A structure such as a gas-spring is also capable of exerting the bias-force with the preferred degree of constancy.

The magnitude of the biasing-force should be set (by the designers and/or the operational engineers) such that there exists, in operation of the tool, an equalization-level of the PDAF. The equalization-level of the PDAF is that level of the PDAF at which the PDAF-force acting on the piston in the direction to open the pulse-valve is balanced by the biasing-force acting on the piston in the direction to close the pulse-valve. In the depicted tools, when the tool is operated in an environment in which the PDAF varies over a range from a highest level to a lowest level, during the course of pulsing, the magnitude of the biasing-force should be such that the equalization-level of the PDAF falls between the desired highest and the expected lowest limits of the PDAF. When the biasing-force is within that range, the tool cycles automatically between an injection-phase in which the pulse-valve is open and fluid is being injected into the formation and the PDAF is falling, and a recovery- or recharge-phase in which the pulse-valve is closed and the PDAF is rising.

The depicted tools are so designed that, when the pulse-valve opens, the PDAF drops, and when the pulse-valve closes, the PDAF rises. The pulse-valve opens when the rising PDAF has reached its highest level, and the pulse-valve closes when the falling PDAF has reached its lowest level—or, in other words, the highest level of the PDAF occurs just before the pulse-valve opens, and the lowest level of the PDAF occurs just before the pulse-valve closes. The designable and settable parameters include the spring rate and force, and the relative areas of the accumulator-surface of the piston (which is exposed to accumulator-pressure) and the formation-surface of the piston (which is exposed to formation-pressure).

In the depicted designs of FIGS. 5-8 and FIGS. 15-19, when the pulse-valve is closed, it is triggered to open by providing an opening-inhibitor, which is arranged first to restrain the movement of the valve-piston, and then to disable or release that restraint. The engineer should arrange the inhibitor timing to be of such duration as to enable the rising PDAF to rise to the desired highest level of the PDAF, just as the inhibitor releases the valve-piston.

In the tool variant of FIGS. 15-19, a corresponding time-delayed inhibitor is also provided in relation to the closing of the pulse-valve, to ensure that the pulse-valve remains open until the PDAF has dropped below the equalization level of the PDAF.

Thus, in the design of FIGS. 5-8, the lowest PDAF coincides with the closing of the pulse-valve, whereby no closing-inhibitor is required. In FIGS. 15-19, the closing of the pulse-valve is delayed, whereby the PDAF falls below the equalization-level of the PDAF before the pulse-valve actually closes.

Just before the pulse-valve closes, the PDAF has fallen to its lowest level, and once the pulse-valve closes, the PDAF starts to increase. That is to say, the pulse-valve being now closed, pressurized fluid from the reservoir now refills or re-charges the accumulator, and thus the accumulator-pressure starts to increase; and also, the pulse-valve being now closed, and no further fluid being now injected into the formation, the just-injected fluid dissipates into the formation, and thus the formation-pressure starts to decrease. When the pulse-valve is closed, the PDAF rises.

Just before the pulse-valve opens, the PDAF has risen to its highest level, and once the pulse-valve opens, the PDAF starts to fall. That is to say, the pulse-valve being now open, pressurized fluid from the accumulator now pours out through the pulse-valve, whereby the accumulator pressure decreases and the formation-pressure increases. When the pulse-valve is open, the PDAF falls.

In the depicted designs, when the pulse-valve is open and the PDAF is falling, there comes a point at which the pulse-valve is triggered to close; and when the pulse-valve is closed and the PDAF is rising, there comes a point at which the pulse-valve is triggered to open. The factor that triggers the pulse-valve to open is that the piston, having moved slowly towards the position at which the piston opens the pulse-valve, moves over, i.e exposes, the unrestricted, i.e wide-open port (being the mouth 61 of the conduit 63 in FIG. 8 and being the lip 188 of the catchpot chamber 187 in FIG. 15), whereupon the piston now moves very rapidly to open the pulse-valve. While the piston was moving slowly towards the valve-opening position, of course the PDAF was rising. But the actual trigger that opens the pulse-valve is the fact that the piston exposes the wide mouth of a port.

Thus, the tool, constructed and arranged and operated as described, automatically alternates between its pulse-valve-open (injection) condition and its pulse-valve-closed (recovery, or re-charge) condition, and thus automatically injects pulses of pressurized fluid into the ground formation, at a cyclical frequency.

As mentioned, preferably, the fluid should be expelled from the pulse-valve, and out into the formation, at high pressure, and with an energetic porosity-wave. The key to achieving this preference is to hold back the pulse-valve from opening until the PDAF has built up to a high level (which generally should be as high as possible, within the permitted pressure limits of the well) and, when the pulse-valve finally does open, to ensure that the pulse-valve moves from its closed condition to its wide-open condition as rapidly as possible.

Preferably, the high-level of the PDAF, at the moment of opening, should be high enough to blow the pulse-valve open explosively. Thus, the preference to have a large PDAF available when the valve opens, and the preference to make the valve open explosively, are very compatible with each other, and both can be achieved by the provision of an inhibitor mechanism.

The following is a list of the numerals used in the drawings.

20 pulsing tool
21 tubular body
23 pulse-valve
25 movable valve-member
27 piston
29 ground formation
30 well-casing
32 annulus
34 perforations
36 accumulator zone
38 valve-spring
40 valve-seat
41 balance seal
43 hammer
45 hammer-spring
47 pulse-valve
49 valve-member
50 hub of 49
52 dashpot unit (FIG. 5)
54 hammer
56 shoulder
58 axially-floating sleeve
60 top end of sleeve 58
61 mouth of . . .
63 oil-conduit
65 bore
67 enclosed volume
69 tool body
70 head of 54
72 ledge on 54
74 equaliser-piston
76 gas-pressurised accumulator (FIG. 9)
78 gas-chamber
80 accumulator-piston
81 accumulator-tube
83 accumulator-conduit
85 non-return valve
87 non-return valve spring
90 nose
92 bore
93 space
94 injection check valve (FIG. 11)
96 ICV-piston
98 ICV-spring
100 ICV-seat
101 passageway
103*a* area above choke 105
103*b* area below choke 105
105 choke
107 orifice
109 area below 94
120 static injection sub-assembly (FIG. 13)
121 tubing above tool

123 SIS-conduit
125 SIS check-valve
127 inflatable packer
129 annulus above packer
160 injection-ports (FIG. 15)
163 body of tool
167 piston
169 top seal
170 middle seal
172 bottom seal
173 dashpot-chamber
174 constricted-port
175 piston-spring
176 drain
178 shoulder
180 discharge-port
185 nose
187 catchpot-chamber
189 catchpot check-valve
190 catchpot-orifice
192 dashpot check-valve

The invention claimed is:

1. A down-hole tool which is operable to create cyclic pulses in liquid from a reservoir being injected out from a hole in the ground into the surrounding ground formation, wherein:

the tool includes a pulse-valve, having a valve-member and a valve-housing;

the valve-member is movable relative to the valve-housing between an open position of the pulse-valve, in which pressurized liquid can pass through the pulse-valve out of the tool and into the formation, and a closed position;

the tool includes an accumulator, which is arranged for storing pressurized liquid from the reservoir at a magnitude of pressure termed the accumulator-pressure, ready for presentation to the pulse-valve;

the tool and the reservoir are so arranged that, during operation, when the pulse-valve is closed the PDAF increases, and when the pulse-valve is open the PDAF decreases;

the tool includes a valve-cylinder and relatively movable valve-piston;

the valve-piston is so connected to the valve-member as to be movable therewith;

an accumulator-surface of the valve-piston is defined as that surface of the valve-piston, the whole of which, throughout operation of the tool to create cyclic pulses, is exposed to accumulator-pressure;

a formation-surface of the valve-piston is defined as that surface of the valve-piston, the whole of which, throughout operation of the tool, is exposed to formation-pressure;

the tool is so arranged that, throughout operation of the tool, accumulator-pressure acting on the accumulator-surface urges the valve-piston in a direction to open the pulse-valve, and the formation-pressure acting on the formation-surface urges the piston in a direction to close the pulse-valve, whereby the valve-piston is subjected to a net force, termed the PDAF-force;

the tool includes a valve-piston-seal, which seals the valve-piston to the valve-cylinder, between the accumulator-surface and the formation-surface, throughout operation of the tool;

the tool is so arranged that, in operation, the accumulator-pressure being higher than the formation-pressure, the PDAF-force acting on the valve-piston is so directed as to urge the valve-piston to move in the direction to open the pulse-valve;

the tool includes a piston-biassing means, which is so arranged in the tool as to provide, throughout operation of the tool, a biassing-force that acts upon the valve-piston in such direction as to urge the pulse-valve to its closed position.

2. As in claim 1, wherein:

the magnitude of the biassing-force is such that there exists, in operation of the tool, an equalization-level of the PDAF;

the equalization-level of the PDAF is a level of the PDAF at which the PDAF-force acting on the piston in the direction to open the pulse-valve is balanced by the biassing-force acting on the piston in the direction to close the pulse-valve;

whereby, when the tool is operated in an environment in which the PDAF varies over a range from a highest level to a lowest level, during the course of pulsing, and when the magnitude of the biassing-force is such that the equalization-level of the PDAF falls within the said range, the tool cycles automatically between an injection-phase in which the pulse-valve is open and liquid is being injected into the formation and the PDAF is falling, and a recovery- or recharge-phase in which the pulse-valve is closed and the PDAF is rising.

3. As in claim 2, wherein:

the tool includes an opening-trigger, which is effective, the pulse-valve having closed, first to prevent the pulse-valve from opening, and then later to release the pulse-valve to open;

the opening-trigger includes an operable opening-inhibitor, which operates in response to the closing of the pulse-valve, and is effective, when operated, to inhibit the pulse-valve from opening;

the opening-trigger includes an operable opening-inhibitor-disabler, which operates in response to the PDAF having increased, over a period of time, to a high-level of the PDAF;

the opening-inhibitor-disabler is effective, when operated, to disable the opening-inhibitor, and to release the pulse-valve to open.

4. As in claim 3, wherein:

the opening-inhibitor includes walls that define a dashpot-chamber of variable volume;

the opening-inhibitor is effective to enable the pulse-valve to remain closed, for a period of time, even though the rising PDAF has increased above its equalization-level;

the opening-inhibitor is so arranged that the presence of pressurized liquid in the dashpot-chamber is effective to inhibit movement of the valve-piston in the direction to open the pulse-valve;

the said period of time is determined by the structure of the dashpot;

the walls of the dashpot-chamber include a constricted-port, which is so structured that liquid can only leak out of the dashpot-chamber at a restricted flowrate;

the walls of dashpot-chamber include a wide-port, which is so structured that, when the wide-port is open, liquid can leave the dashpot-chamber therethrough at a rapid flowrate;

the walls of the dashpot-chamber include a recharge-port, through which liquid outside the dashpot-chamber at a higher pressure than liquid already in the dashpot-chamber can enter the dashpot-chamber;

the opening-inhibitor-disabler includes a configuration of the wide-port in relation to the valve-piston such that liquid can only leave the dashpot-chamber through the wide-port after a substantial quantity of liquid has already escaped from the dashpot-chamber through the constricted-port, and after the volume of the dashpot-chamber has substantially decreased;

the period of time starts when, the dashpot-chamber having been refilled, liquid starts to leak out of the dashpot-chamber through the constricted-port; and the period of time ends when liquid starts to leave the dashpot-chamber at a rapid flowrate through the wide-port.

5. As in claim 4, wherein:

the dashpot-chamber and a recovery-chamber are respective sub-chambers of the inhibitor mechanism;

the constricted-port, the wide-port, and the entry-port, communicate the dashpot-chamber with the recovery-chamber;

the dashpot-chamber and the recovery-chamber together form an inhibitor-chamber of the inhibitor mechanism of the tool;

the inhibitor mechanism is so arranged that, during operation, the recovery-chamber is in pressure-equalizing communication with the formation; and either the inhibitor-chamber is an enclosed, sealed, chamber, containing a fixed quantity of a dashpot-liquid;

or the recovery-chamber of the inhibitor is in open fluid-conveying communication with the formation, whereby liquid pressure in the recovery-chamber substantially equals the formation-pressure.

6. As in claim 2, wherein:

the tool includes a closing-trigger, which is effective, the pulse-valve having opened, first to prevent the pulse-valve from closing, and then later to release the pulse-valve to close;

the closing-trigger includes an operable closing-inhibitor, which operates in response to the opening of the pulse-valve, and is effective, when operated, to inhibit the pulse-valve from closing;

the closing-trigger includes an operable closing-inhibitor-disabler, which operates in response to the PDAF having fallen, over a period of time, to a low-level of the PDAF;

the closing-inhibitor-disabler is effective, when operated, to disable the closing-inhibitor, and to release the pulse-valve to close.

7. As in claim 6, wherein:

[2] the closing-inhibitor includes walls that define a catch-pot-chamber of variable volume;

the closing-inhibitor is effective to enable the pulse-valve to remain open for a period of time, even though the falling PDAF has decreased below its equalization-level;

the closing-inhibitor is so arranged that the presence of reduced-pressure liquid in the catchpot-chamber is effective to inhibit movement of the valve-piston in the direction to close the pulse-valve;

the said period of time is determined by the structure of the catchpot;

the walls of the catchpot-chamber include a constricted-port, which is so structured that liquid can only leak into the catchpot-chamber at a restricted flowrate;

the walls of the catchpot-chamber include a wide-port, which is so structured that, when the wide-port is open, liquid can enter the catchpot-chamber at a rapid flowrate;

the walls of the catchpot-chamber include a recharge-port, through which liquid inside the catchpot-chamber at a higher pressure than liquid outside the catchpot-chamber can leave the catchpot-chamber;

the closing-inhibitor-disabler includes the placement of the wide-port in relation to the valve-piston such that liquid can only enter the catchpot-chamber through the wide-port after a substantial quantity of liquid has already entered the catchpot-chamber through the constricted-port, and after the volume of the catchpot-chamber has thereby substantially increased;

the period of time starts when liquid starts to leak into the catchpot-chamber through the constricted-port; and the period of time ends when liquid starts to enter the catchpot-chamber at a rapid flowrate through the wide-port.

8. As in claim 1, wherein:

[2] the accumulator is located in the tool in close proximity to the pulse-valve;

the accumulator includes an accumulator-resilience, which is so structured that:

the volume of the accumulator-chamber is variable in proportion to the accumulator-pressure;

the volume of the accumulator-chamber is variable over substantially the whole range of the accumulator-pressure, being the range over which, during operation of the tool, the PDAF is at its highest or its lowest level, or any level therebetween, including the said equalization-level.

9. As in claim 1, wherein:

the tool includes an injection check valve (ICV);

the ICV includes an ICV-piston and an ICV-spring;

the ICV includes an ICV-main-conduit through which liquid from the reservoir passes, upon being conveyed to the pulse-valve;

the ICV-piston includes a restrictor or choke, through which the said flow in the ICV-main-conduit also passes;

the choke has a smaller flow-conveying area than the ICV-main-conduit, to the extent that, when flowrate through the ICV-conduit is rapid, a pressure differential develops between the upstream side and the downstream side of the choke, the magnitude of the differential being proportional to the flowrate through the choke;

the ICV-piston is movable in response to the said pressure differential, against the ICV-spring, in such manner as to close an ICV-flow-control-valve;

whereby flowrate through the ICV-conduit is self-inhibiting.

10. As in claim 1, wherein:

[2] the tool includes a static injection sub-assembly (SIS);

the SIS includes an SIS-conduit through which liquid from the reservoir passes, upon being conveyed to the pulse-valve;

the SIS includes an SIS-check-valve which is so structured and located as to enable excess pressure inside the SIS-conduit to emerge into the formation, without passing through the pulse-valve.

11. As in claim 1, wherein the tool includes the accumulator, an injection check valve, and a static injection sub-assembly which are arranged, in the down-hole tool, above the pulse valve, and one above the other.

12. As in claim 1, wherein the tool is so arranged that, throughout operation of the tool, the piston-biassing means urges the valve-piston in a direction to close the pulse-valve.

* * * * *